US006551196B1

(12) United States Patent
Kossnar et al.

(10) Patent No.: US 6,551,196 B1
(45) Date of Patent: Apr. 22, 2003

(54) FREESTANDING GOLF SWING TRAINING SYSTEM

(75) Inventors: Dennis J. Kossnar, Wheaton, IL (US); Stephanie P. Kossnar, Wheaton, IL (US); Daniel A. Maust, Winfield, IL (US)

(73) Assignee: John W. Deabler, Inc., Waukesha, WI (US)

( * ) Notice: Subject to any disclaimer, the term of this patent is extended or adjusted under 35 U.S.C. 154(b) by 21 days.

(21) Appl. No.: 09/633,667

(22) Filed: Aug. 7, 2000

Related U.S. Application Data

(63) Continuation-in-part of application No. 09/440,846, filed on Nov. 16, 1999, which is a continuation-in-part of application No. 09/237,572, filed on Jan. 26, 1999, now Pat. No. 5,984,797.

(51) Int. Cl.[7] ..... A63B 69/36

(52) U.S. Cl. ..... 473/216; 473/277

(58) Field of Search ..... 473/216, 277, 473/252, 183

(56) References Cited

U.S. PATENT DOCUMENTS 2,611,610 A * 9/1952 Hara
2,626,151 A * 1/1953 Jenks
5,050,885 A * 9/1991 Ballard et al.
5,984,797 A * 11/1999 Kessler et al.

* cited by examiner

*Primary Examiner*—Paul T. Sewell
*Assistant Examiner*—Nini F. Legesse
(74) *Attorney, Agent, or Firm*—Dillis V. Allen, Esq.

(57) ABSTRACT

An improved freestanding golf swing training system with a floor-mounted base 9or mounted-to-ground post) and a pelvic belt assembly that wraps around the golfer's hips and guides the golfer's pivot during the backswing, downswing and follow through. The adjustable, dual-axis system guides the pelvis as it pivots about an axis behindthe golfer's right leg (for right handers) in the backswing and downswing, and pivots about an axis behind and outside the golfer's left leg in the follow through. A dual-pivot mechanism, that connects the belt to the base, inhibits lateral movement of the hips during the backswing and downswing. The mechanism allows the distance between the pivot centers to be adjustable to various hip sizes. The system has a built-in conversion feature that permits the belt to be inverted to accommodate both right-handed and left-handed golfers.

27 Claims, 26 Drawing Sheets

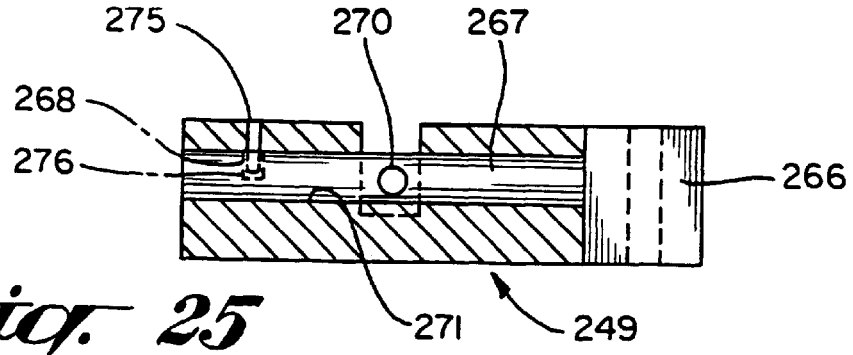
Fig. 25
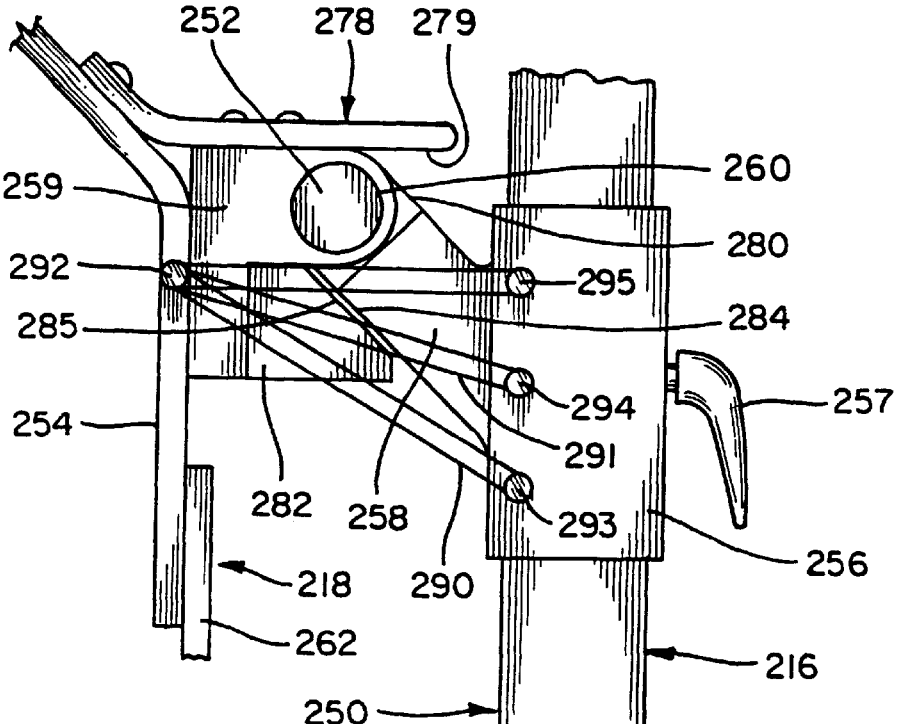
Fig. 26
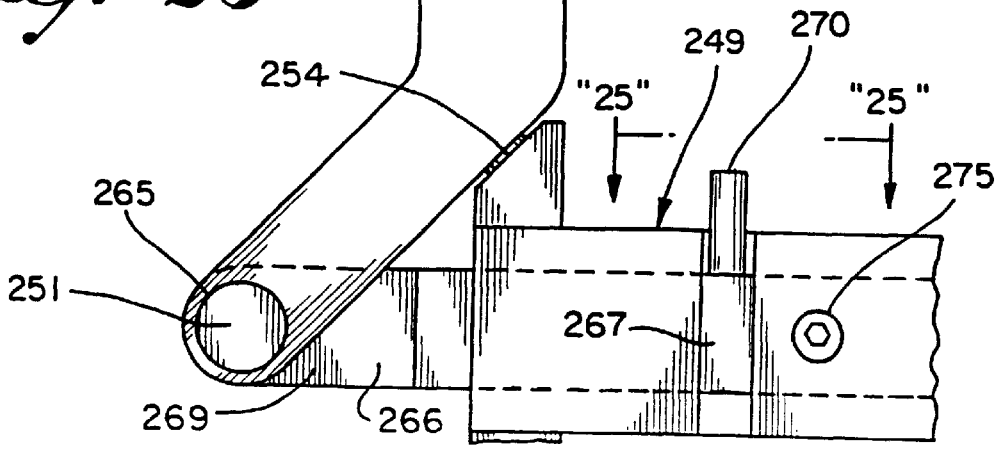

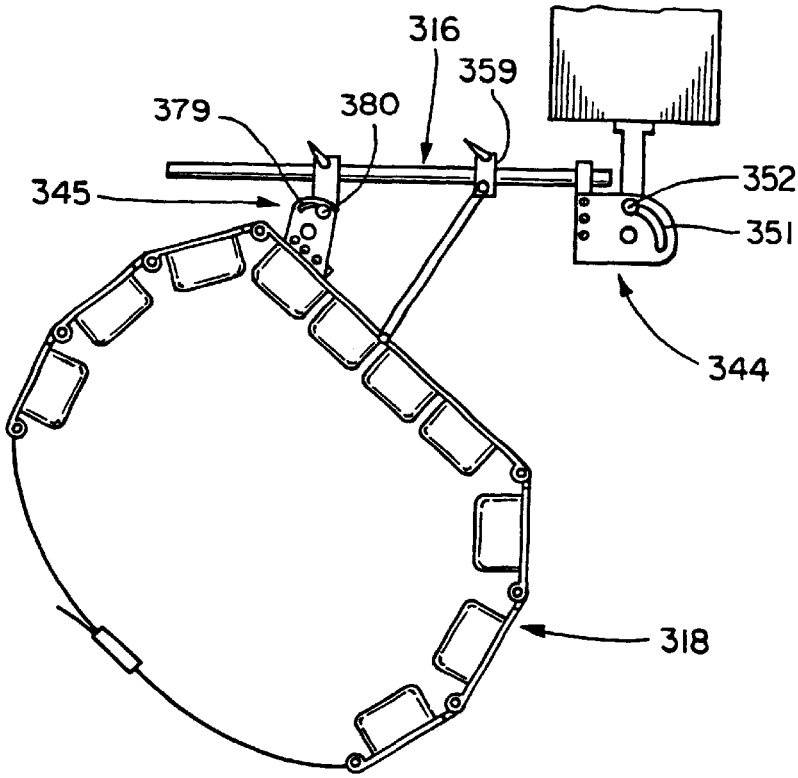
Fig. 45
(45° BACK SWING)
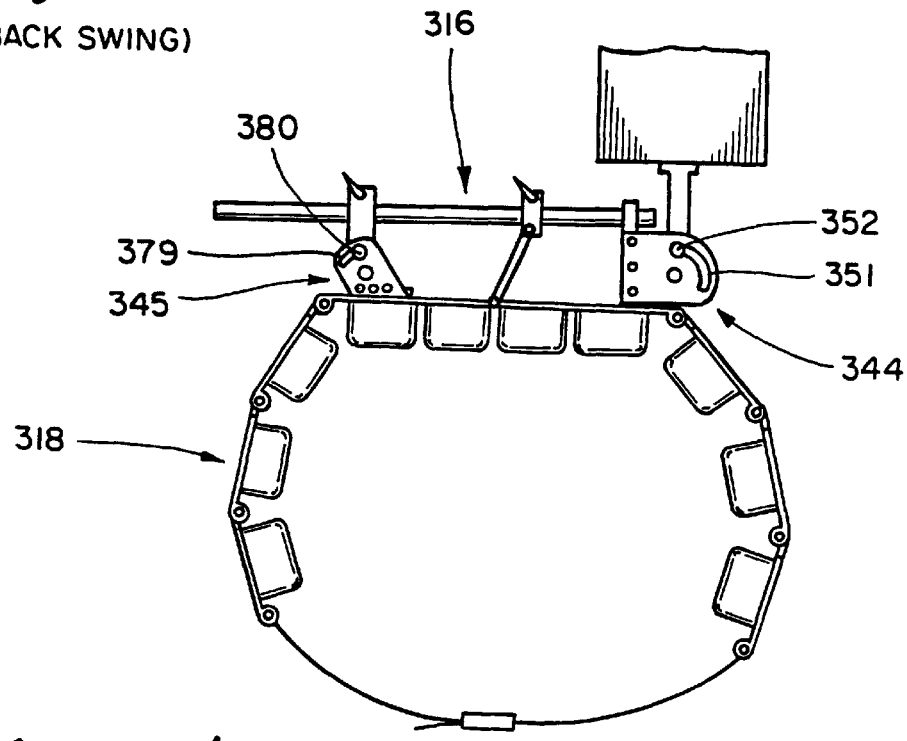
Fig. 46 (AT IMPACT)

(45° FOLLOW THRU)

(90° FOLLOW THRU)

(106° FOLLOW THRU)

FREESTANDING GOLF SWING TRAINING SYSTEM

RELATED APPLICATION

This application is a Continuation-in-Part of U.S. Ser. No. 09/440,846, Filed: Nov. 16, 1999, entitled "IMPROVED GOLF SWING TRAINING SYSTEM", which is a Continuation-in-Part of U.S. Ser. No. 09/237,572, Filed: Jan. 26, 1999, entitled "GOLF SWING TRAINING SYSTEM", now U.S. Pat. No. 5,984,797, Issued: Nov. 16, 1999.

BACKGROUND OF THE INVENTION

As golfers have searched vainly for the perfect golf swing over the last 150 years in the history of this game, teachers and engineers have sought and designed teaching aids that hopefully will improve the golfer's swing to hit the ball more consistently and further.

One such tool is a golf swing training system shown in the Ballard, et al., U.S. Pat. No. 5,050,885. The Ballard system includes a shoulder guiding device 122, 130, and 135 and a hip saddle 112 that straps around the pupil's hip area. The thrust of the Ballard system is the provision of a lateral slide 90 on the base that permits the belt and the golfer's hips to slide from two to six inches during the back swing, the down swing, and follow through. The slide 90 has a pair of rollers 87 and 88 that ride on a linear rail 61 that is parallel to the target line. Pivotal movement of the saddle is accommodated by a shaft 57 that permits the saddle to pivot about a horizontal axis perpendicular to the target line to accommodate the player's tendency to raise one hip relative to the other. The sliding carriage is pivotally mounted on the base about a horizontal axis shown in FIG. 5, parallel to the target line and biased by a spring 51 that appears to accommodate the downward movement of the hips during the golf swing.

The slide 90 carries a first pivot 94, as seen in FIG. 9, upon which a link 99 is pivotal having another pivot 93 at its distal end to which the hip saddle 91 is connected. At the address position illustrated in FIG. 15, the slide 90 is positioned centrally on the rail 61 by springs 84 and 85, hip saddle 91 faces the ball, and the pivoting link 99 is parallel to the target line. During the back swing as depicted in FIG. 16, the slide 90 slides linearly away from the target compressing spring 84, and the belt pivots 45 degrees about the pivot 94, causing the user's spine to shift backwardly a substantial distance rearwardly from the ball.

During the down swing, the belt pivot 93 and the slide 90 slide toward the target back to substantially the address position described above. Thereafter, during the follow through, the link 99 rotates counter-clockwise from its address position and actually throws the golfer toward the golf ball a substantial distance during the follow through. At the same time, the slide 90 compresses spring 85, causing a substantial lateral shift of the hips during the follow through compressing spring 85, as depicted in FIG. 17.

The lateral shifting of the saddle in the Ballard system during both the backswing and the downswing is not believed by most teaching professionals to be an appropriate teaching methodology.

The Remington, U.S. Pat. No. 1,530,519, shows a golf training apparatus designed to prevent any vertical or upward motion during golf swing. The golfer is restricted to pivoting his body around the fixed axis.

The Hara, U.S. Pat. No. 2,611,610, shows a mechanical system that holds the shoulders, hips and feet in position during the swing.

Another Hara, U.S. Pat. No. 2,755,091, shows a teaching device that restricts the golfer's hip movement to rotary motion about a single axis, as does the device shown in the Abel, U.S. Pat. No. 3,429,571.

The Sheldon, U.S. Pat. No. 3,215,438, shows a hip training device for golfers that gives a warning signal when hip rotation departs from a single axis.

The Anselmo, et al., U.S. Pat. No. 4,593,909, has similar deficiencies to the Sheldon system.

The Jenks, U.S. Pat. Nos. 2,626,151, and 2,737,432, show golf training systems which coordinate body movement with some lateral movement of the hips.

The following patents also show swing training device as described in U.S. Pat. No. 5,984,797 referred to above.

| Inventor | Patent No. | Issue Date |
|---|---|---|
| Strong | 4,691,924 | Sept. 8, 1987 |
| Bambrick | 1,854,392 | Apr. 19, 1932 |
| Boldt | 3,415,523 | Feb. 10, 1968 |
| Oppenheimer | 3,876,212 | Apr. 8, 1975 |
| Morris | 3,895,366 | Jul. 15, 1975 |
| Oppenheimer | 3,917,281 | Nov. 4, 1975 |
| Oppenheimer | 4,034,991 | Jul. 12, 1977 |
| Beckish | 4,071,251 | Jan. 31, 1978 |
| Oppenheimer | 4,211,418 | Jul. 8, 1980 |
| Kiehl | 4,326,718 | Apr. 27, 1982 |
| Vuick | 4,659,084 | Apr. 21, 1987 |

The multiple pivot mechanism that connects the belt to the base inhibits lateral movement of the hips during the back swing and down swing. The belt is connected to the base by an expandable link pivotally connected at one end to the base and pivotally connected at its other end to the belt, both about generally vertical axes. As the golfer initiates the back swing, the belt pivots about the second axis as the link pivots in the opposite direction about the first axis. The link, as it rotates, expands somewhat as the spine travels in a clockwise arc about the pivot axis to the rear and inside of the right hip socket. As the golfer initiates the downswing, the link collapses and moves to a position almost parallel to the target line but somewhat outward from the address position. In the ball impact position, the link is collapsed between the belt and the base substantially parallel to the target line. The extension of the link during the backswing is what encourages the left hip to move clockwise and the spine to travel on the appropriate arc.

During the follow through, the link swings counter-clockwise allowing the right hip to move counter-clockwise and the spine to trace the appropriate arc which is an arc generally about the axis outside and to the rear of the left hip socket. After the follow through with the link collapsed and generally parallel to the target line, the golfer is encouraged to step forward toward the target by the expandable link which permits extension of the belt toward the target as the golfer takes an extra step with the rear leg over the forward leg toward the target encouraging an exceptional follow through.

In patent application, U.S. Ser. No. 09/440,846, Filed: Nov. 16, 1999, a golf swing training system is disclosed that guides the golfer's hip rotation during the backswing and downswing and the follow through which, with repetition, enables the golfer's muscle memory to repeat the desired hip rotation on the golf course without the training system. This hip rotation concept involves the pivotal motion of the hips during the backswing and downswing about a generally vertical axis behind and outside of the right hip socket(for right-handed golfers). During the follow through, the pivotal axis for the hips switches to a generally vertical axis outside and behind the left hip socket. This dual axis hip pivot automatically teaches the golfer the proper weight transfer from the right side to the left side.

Two of the principal advantages of that training system is that it eliminates undesirable hip sway and pivoting around a single axis that is taught in several prior swing training systems, such as the ones described in the Background of the Invention. Hip sway is the lateral or sliding movement of the hips in a plane parallel to the target line—and this motion is difficult for the golfer to control because the rear sway during the backswing requires a perfectly timed forward sway in the downswing to position the club properly at impact.

A further feature of that system is that it encourages without demanding the forward step of the rear leg over the forward leg after the follow through. This step teaches the golfer the proper total weight transfer to the left and is a valuable training tool. In fact, top professional golfers, such as present senior player Gary Player actually use this step while on the golf course.

Toward these ends, that golf swing training system includes a floor mounted base and a pelvic belt that wraps around the golfer's hips and guides the golfer's pivot during the backswing and follow through. The multiple pivot mechanism that connects the belt to the base inhibits lateral movement of the hips during the backswing and downswing. The belt is pivotally connected at a point B at one end to the base and pivotally connected at a point A at its other end to the belt, both about generally vertical aces. As the golfer initiates the backswing, the belt pivots about the axis (A) to approximately the limit of 45 deg. of turn as the right hip and spine travel in a clockwise arc(for right-handed golfers) about the pivot axis that is behind and outside of the right hip socket. At this point the movement is halted by a solid stop mechanism. As the golfer initiates the downswing, the hip belt pivots on axis (A) in the reverse direction back to its original square address position. Immediately, the initiation of the follow through begins with the second pivot point at axis (B), (a point on the outside and behind the left hip socket), allowing the golfer's left hip and spine to move on an arc counterclockwise on that axis to a position facing the target and perpendicular to the target line.

Golf instructors use a variety of exercises to promote the development of the proper basic swing including having golfers execute a swing while standing with their buttocks up against a wall. This provides a demonstratable rear plane behind which no part of the golfer's body or the club can cross during the backswing or follow through. As the machine controls the golfer's motion, it promotes a simplified basic swing. This exaggerated exercise leaves the student with the "feel" required to repeatedly execute his or her own individual swing with confidence when out of the machine. Previous training devices, including the parent of this C.I.P., do allow for the tracking of the right hip behind this critical back plane. The right hip is supposed to pivot but not move or change positions during the backswing. It is the left hip and spine that move on an arc around pivot point (A). The same holds true for the left hip during follow through when the right hip and spine pivot on an arc around point (B) on the left.

This system design, with the repositioning of the pivot points, the addition of the mechanical stops and the rigid construction of the mechanism, is what dictates that the hips and the spine travel on the appropriate paths.

Each of the first and second pivotal axes of the mechanism can be provided with an optional address biasing system. These address biasing systems are coil compression spring assemblies with an adjustable pre-load that are preset with the proper tension to assure that the belt assembly returns to the neutral position when at rest. Additionally, attached to the belt assembly and pivot block are opposing sets of tension posts; one central post on the top and bottom of the belt bar and multiple posts on the top and bottom of the support block slide mechanism. Tension bands or springs are positioned on these posts in combinations that provide resistance to the golfer's initial pivot. This permits the instructor to adjust the swing resistance based upon the strength, size and ability of the pupil. The swing resistance created by this system not only builds muscles but with repetition, enhances muscle memory more than does a passive training system with no swing resistance.

Today, a major consideration of any device geared for public use, requires a commitment to facilitate both left-handed as well as right-handed participants. Previous devices either did not address this issue well or did not address it at all. A new, remarkably convenient conversion feature has been incorporated into this device allowing the system to be easily switched over without reduction of function from either side. The base mount block has been modified with a centrally positioned cylindrical hole into which a cylindrical "rotation" shaft is inserted. This shaft is connected to the pivot that connects to and supports the hip belt mechanism. The converter "rotation" shaft has a stop pin inserted in it that fits into a groove cut into and intersecting the cylindrical hole in the support block. When the belt mechanism is flipped over to perform the left-right conversion, this pin acts as a positioning stop to keep the belt mechanism level on either side. The mechanism is secured in position by a mechanical pressure locking pin inserted into a hole drilled in the top of the block down into a corresponding pre-positioned hole in the rotation shaft.

Another object of that swing trainer is to achieve a compact swing of the type institutionalized by the swing of Gene Sarazen. That swing is characterized by a full hip turn in the backswing but not more than 45 degrees, a substantial weight shift to the right foot in the backswing without a significant lateral shifting of the hips, a downswing initiated by the lower legs with the hips moving back toward the address position, an impact position with the lower body not leading the upper body significantly in contra-distinction to the Johnny Miller reverse "C" position at impact, with the body generally upright and the shoulders remaining generally horizontal and a compact follow through with the hips facing the target and the hands flowing up and over the head again with the shoulders mainly horizontal.

The U.S. Ser. No. 09/440,846 system achieves these results in part by providing a rigid lateral link between the first pivot and the base to prevent free sliding lateral movement of the belt. Next, the dual pivot positioning permits the free rotational movement of the belt during the backswing and downswing and follow through permitting the golfer's spine to move on the desired arcs. Each of these freedom of movement features are not without limits and while the golfer is permitted some freedom of movement, he or she is still restricted by the mechanical limits of the system; otherwise, the training device would have no purpose.

One of the inventors, Stephanie Kossnar, has been playing golf and delivering golf instruction for over 37 years. She has been involved in training, development of training products, and technical writing for 30 years. Working as a golf instructor for the last 4 years, she has found that the two generally held theories of the golf swing do not explain the actual (or correct) movement of the body during the swing. The first of these concepts is rotating around a central axis during the swing, and the second is where the hips make a lateral movement preceding the rotation for the backswing and the rotation for the downswing.

Because the lower body is the foundation of the swing, and the lower body has two support points (the left leg and the right leg), Stephanie's concept of the swing purports that there are two points of rotation, or axes, in the swing. One of these points is for the backswing and downswing motion and the second for the follow-through. In each rotation, the spine moves on an arc originating about the two axes described above.

During the backswing, the mechanism allows the golfer's weight to be transferred to the inside of the right leg as the spine moves on an arc around the first axis point. The rigid belt holds the golfer's hips in a level position. This discourages a reverse pivot (the weight shifting on the left leg instead of the right). Because the movement of the spine on the arc of the first axis discourages both a lateral movement and a rotation of the hips around a center axis, this movement "pulls" the weight off the left side and onto the right. This also prohibits a reverse pivot.

The position of pivot A allows the left hip to continue on an arc that allows the hips to rotate to 40–45 degrees depending upon the flexibility of the golfer. The proper location of the first axis pivot point restricts the right hip from rotating back beyond the swing/target line of the two axes at the address position. This restriction prevents sway of the lower body. (Sway is defined as an excessive weight shift to the outside of the right leg and foot in a right-handed golfer's backswing that prevents the proper shift back to the left during the downswing). Previous center-axis or lateral-hip-movement training devices allow or encourage sway.

During the downswing, the golfer's spine returns obstensibly to the original stance position. The weight then shifts to the forward or left side, and the second axis defines a new arc formed by the radius between the second axis and the spine. The spine travels along this new arc toward the target until the golfer's body is facing the target on a line perpendicular to the target line.

At this point the golfer's momentum is allowed to continue traveling off the arc toward the target, and he may take a step over to maintain balance.

The golf training apparatus of the present invention virtually demands that the golfer accurately execute these series of steps that make up Stephanie's concept of the golf swing.

In contrast to the system in U.S. Pat. No. 5,984,797, the Continuation-in-Part application, U.S. Ser. No. 09/440,846, includes the repositioning of the two pivot points and the adjustability of the distance between the two pivot points.

In a right handed golfer, the right(back) pivot is now positioned directly to the outside right rear of the right hip joint. The left(front) pivot is adjustable and can and should be positioned to the outside left rear of the left hip joint.

The rear-most corner hinge section of the belt assembly has been repositioned to correspond to the centerline of the rear pivot point(point A). The pivot points should not be mounted any further back from the belt assembly than is mechanically feasible. This acts to keep the hips in front of or on the proper swing/target line during the backswing.

The forward pivot point is moved relative to the pivot bar until it is properly positioned relative to the left (front) hip and then locked in place with the pivot bar lock. This allows for the hips to remain on the swing/target line during follow through. This adjustability feature accommodates various body types and hip structures.

The proper positioning of the pivots in this new assembly eliminates the need for the slide mechanism that functioned as compensation for the pivot points in the parent application.

The slide component and the original position of the pivots allowed the proper swing to be executed with close professional guidance. This mechanism, however, also allowed the user to make moves by not adequately controlling or limiting the user's movements.

Prior to adjusting the pivot centers, several other adjustments are advised. First is the height adjustment to bring the belt assembly to a proper position on the user's hips. Second is the belt width adjustment to assure a secure fit on various body types and sizes.

Another; adjustment feature in Continuation-in-part, U.S. Ser. No. 09/440,846, is a positioning screw that allows the upright support bar of the base to be held in a generally vertical, or slightly forward of vertical, position. This adjustment accommodates the individuality of the user's stances. (This feature eliminates the need for certain components, such as springs, cords or shock absorbers, inside the relatively inaccessible bottom-most housing section of the post assembly).

The springs inside the topmost housing of the post assembly provide,adequate give to allow proper freedom of movement during setup of the address position by the golfers.

Several new mechanical stops have been added to the pivot mechanism that further enhance the function of the new dual-pivot configuration. They act to further control or limit the range of motion possible while using the mechanism.

The first, outside of the rear pivot, limits the belt assembly to a 45 degree motion(turn) during the backswing by contacting the pivot mount which is attached at a 45 degree angle to the pivot hinge on the belt assembly.

The second stop is on the other side of this pivot mount and squares the belt assembly at set-up and also prevents the belt assembly from going back beyond the original on-line position during the downswing.

Additional stops have been added to both sides of the base mounting block to properly position the pivot arm attached to the front pivot assembly. They assure that the belt stays parallel to the swing/target line during the set-up and,rest positions.

Further enhancing the machine's effectiveness is a tension adjustment feature. The belt and pivot grip assemblies have been fitted with a set of pins, both above and below, one on a belt bracket (approximately at the rear pivot point) and several (three as an example) on the pivot arm saddle at varying distances from the center pin.

Through repeated use, this enhancement promotes the user's strength and muscle memory in a physical therapy or rehabilitation function. By attaching one band from the center pin, three different tension positions are possible. By using two bands in tandem from the center pin to the other pins the various combinations of attachment will provide six distinct tension levels.

SUMMARY OF THE PRESENT INVENTION

In accordance with the present invention, an improved freestanding golf swing training system is provided with a floor-mounted base and a pelvic belt assembly that wraps around the golfer's hips and guides the golfer's pivot during the backswing, downswing and follow through.

This new system is philosophically the same as in parent application, U.S. Ser. No. 09/440,846, Filed: Nov. 16, 1999, but contains many structural improvements that enhance. performance, manufacturing, and comfort, as well as safety.

As in U.S. Ser. No. 09/440,846, an adjustable dual axis system is provided that guides the pelvis as it pivots about an axis behind the right leg in the backswing and downswing, and pivots about an axis behind and outside the left leg in the follow through.

The mechanism allows the distance between the pivot centers to be adjustable to various hip sizes, but the belt width is no longer adjustable at its rear because belt flexibility has been increased.

Instead of steps to limit movement about the two pivot axes, arcuate slotted plate and pin assemblies provide improved performance and safety.

The pivotal movement of the columnar base in a vertical plane has been eliminated and replaced with a horizontal pivot in the plane of the belt assembly that accommodates pelvic tilt at address in a far simpler fashion. The rigidity of the base has been improved with three tubular vertical rod supports triangularly arranged and connected together at their bottoms and tops by aluminum extrusions. An additional aluminum extrusion defines a slide on the rod supports and a column head that in turn supports a pivoting slide on the belt assembly.

The pivoting slide is now defined by a pair of rods that define the ways for the belt assembly slide and a separate tension slide. With the tension slide independent of the belt assembly slide, a wide range of neutral tension adjustments may be made.

Rather than providing a plurality of different size cushions on that belt assembly, all cushions are identical to one another and cast or laminated into a composite of different durometer layers for improved belt comfort.

Other objects and advantages will appear more clearly from the following detailed description.

BRIEF DESCRIPTION OF THE DRAWINGS

FIGS. 13 to 19 are schematic top views of the present golf swing training system showing the position of the base column and the belt assembly and linkage in sequence during the back swing, down swing, and follow through;

FIG. 25 is a longitudinal section taken generally along line 25—25 of FIG. 23 showing the left hand to right hand rotational mechanism;

FIG. 26 is a fragmented top view of the belt assembly pivot arm and column head illustrated in FIGS. 1 to 24;

FIG. 45 is a diagrammatic view of the belt assembly in its stop limit backswing position;

FIG. 46 is a diagrammatic view of the belt assembly at impact;

FIG. 47 is a diagrammatic view of the belt assembly approximately halfway through the follow through;

FIG. 48 is a diagrammatic view of the belt assembly at 90 degrees of follow through, and;

FIG. 49 is a diagrammatic view of the belt assembly at 106 degrees of follow through.

DETAILED DESCRIPTION OF THE PREFERRED EMBODIMENTS

Figure 1:
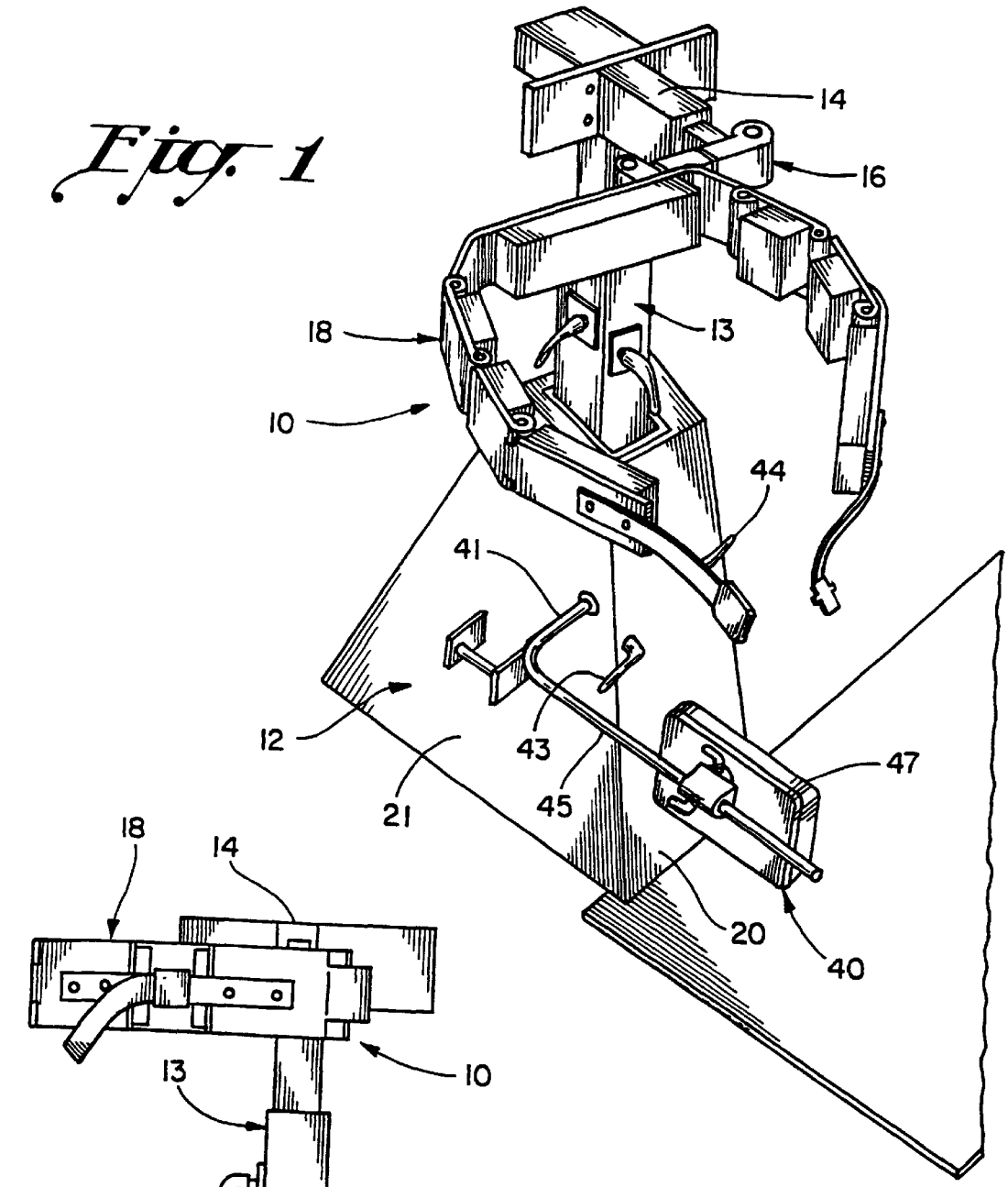
FIG. 1 is a perspective view of the present golf swing training system.
Figure 2:
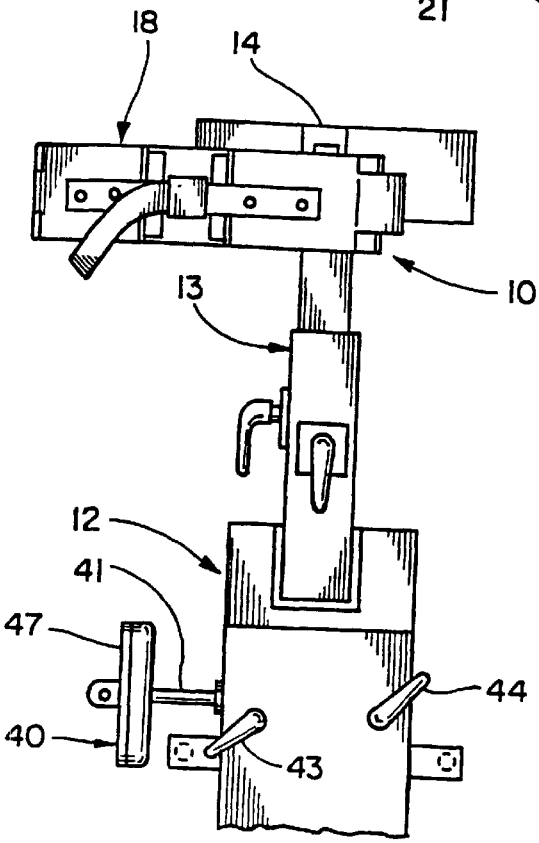
FIG. 2 is a partly fragmented front view of the present golf swing training system illustrated in FIG. 1.
Figure 3:
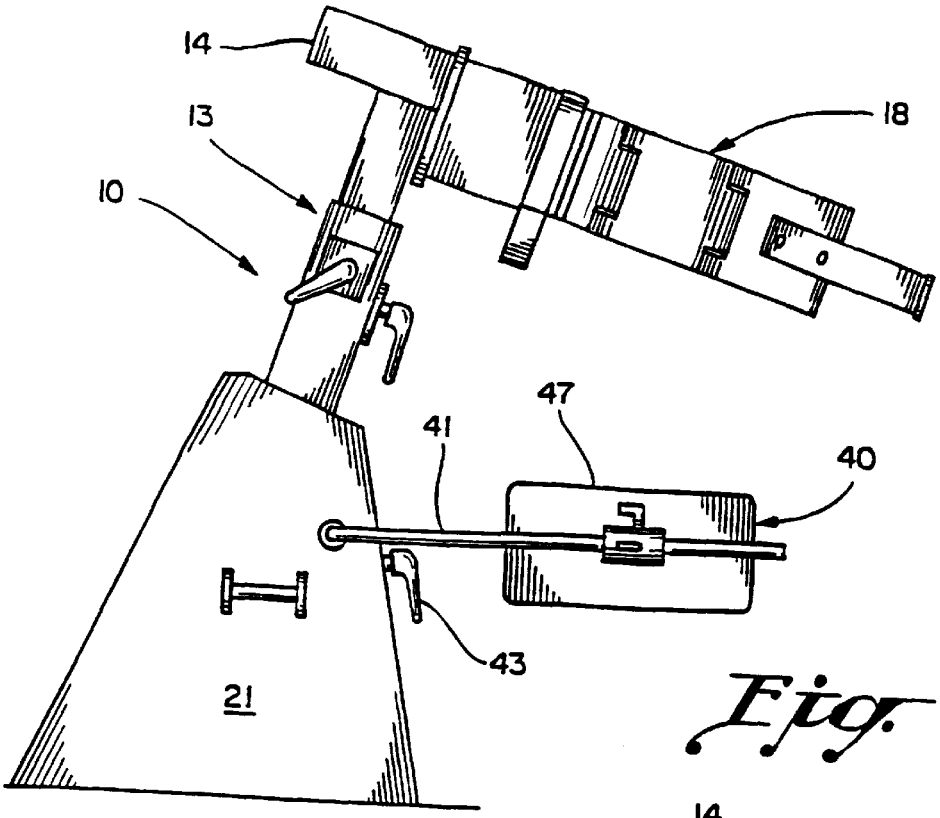
FIG. 3 is a left side view of the golf swing training system shown in FIGS. 1 and 2.

Referring to the drawings and particularly FIGS. 1 to 8, a golf swing training system 10 is illustrated consisting generally of a base 12, a vertically extendable column assembly 13 pivotally mounted in the base 12, a column head 14 fixed to the top of the column assembly 13, an expandable pivotal link assembly 16 carried by the head 14, and pivotally supporting a hip belt assembly 18, which is adapted to be strapped about the golf pupil's hips. The base 12 has a truncated pyramidal shape including front wall 20, side walls 21 and 22, a rear wall 24, a bottom wall 25, and a top wall 26 through which pivotal column assembly 13 projects.

Figure 7:
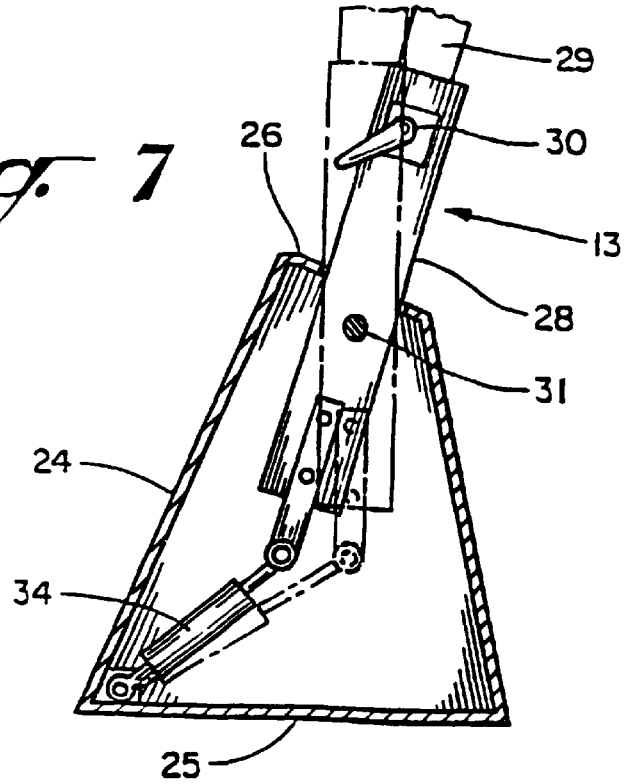
FIG. 7 is a partly fragmented left side view of the base of the golf swing training system illustrated in FIGS. 1 to 6.
Figure 8:
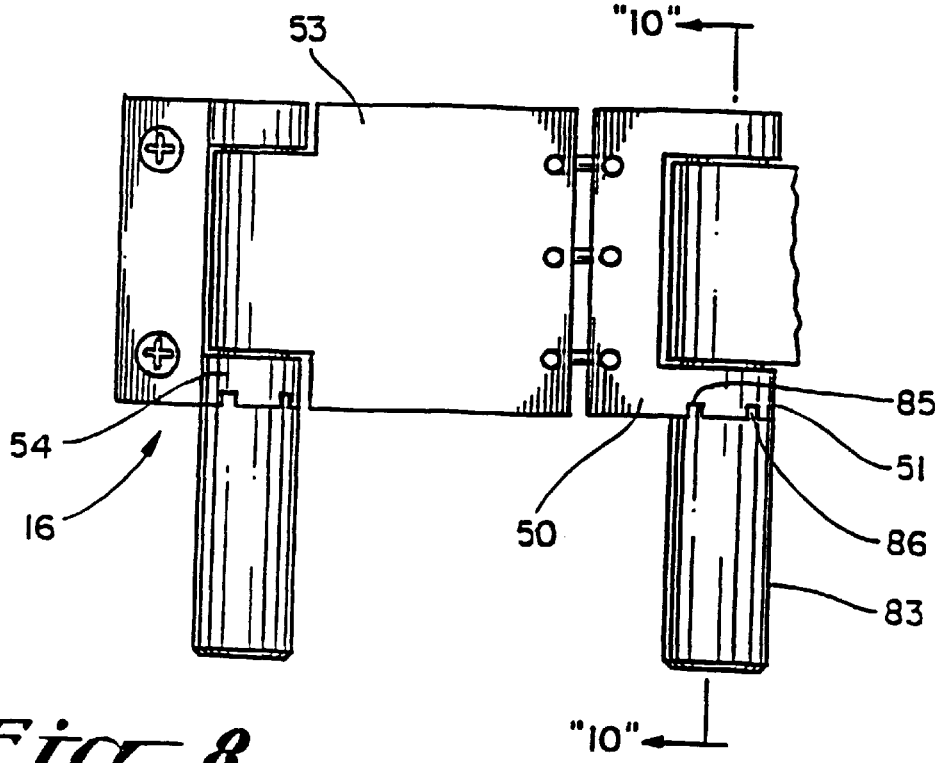
FIG. 8 is an enlarged fragmentary section of the expandable link taken generally along line 8—8 of FIG. 6.

As seen in FIG. 7, the column assembly 13 includes a lower channel member 28, generally rectangular in cross section that slidably receives an inner channel member 29 that is vertically adjustable in the lower channel member and locked in position by a handle-operated stop 30. In this way, the belt assembly 18 can be adjusted to the appropriate hip height of the golfer. The lower column channel 28 is pivotally mounted on rod 31, shown more clearly in FIG. 5. The lower column channel 28 is biased to its vertical position by a pair of hydraulic biasing element cylinders 33 and 34 fixed to the lower portions of the side walls 21 and 22 at one end, and to brackets 36 carried by the lower end of column channel 28. The pivoting of column assembly 13 about rod 31 enables the belt to move in a plane transverse to target line toward and away from the ball as the golfer swings.

Figures 5, 6:
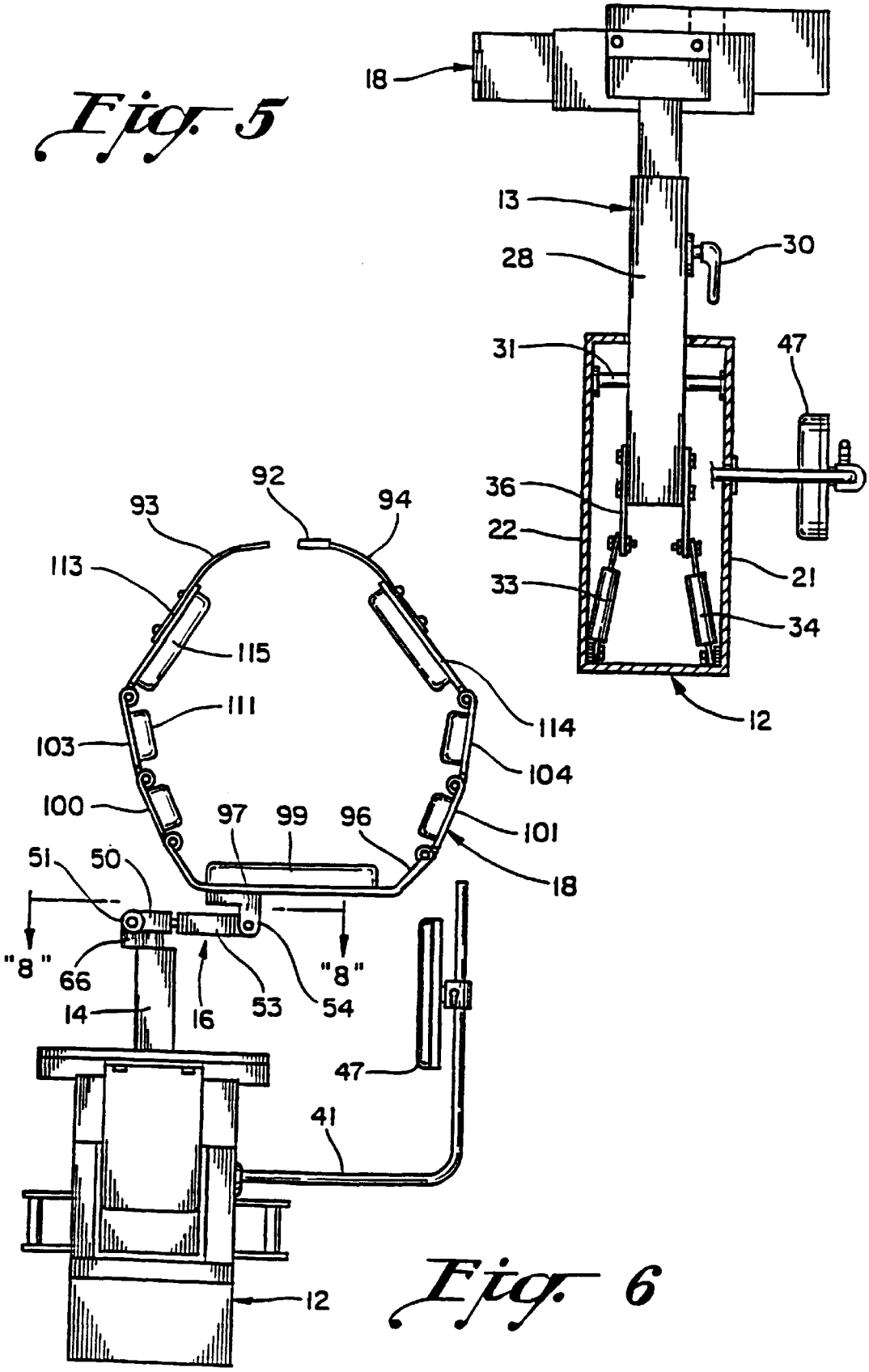
FIG. 5 is a partly fragmented rear view of the golf swing training system as shown in FIGS. 1 to 4.
FIG. 6 is a top view of the golf swing training system illustrated in FIGS. 1 to 5.
Figure 12:
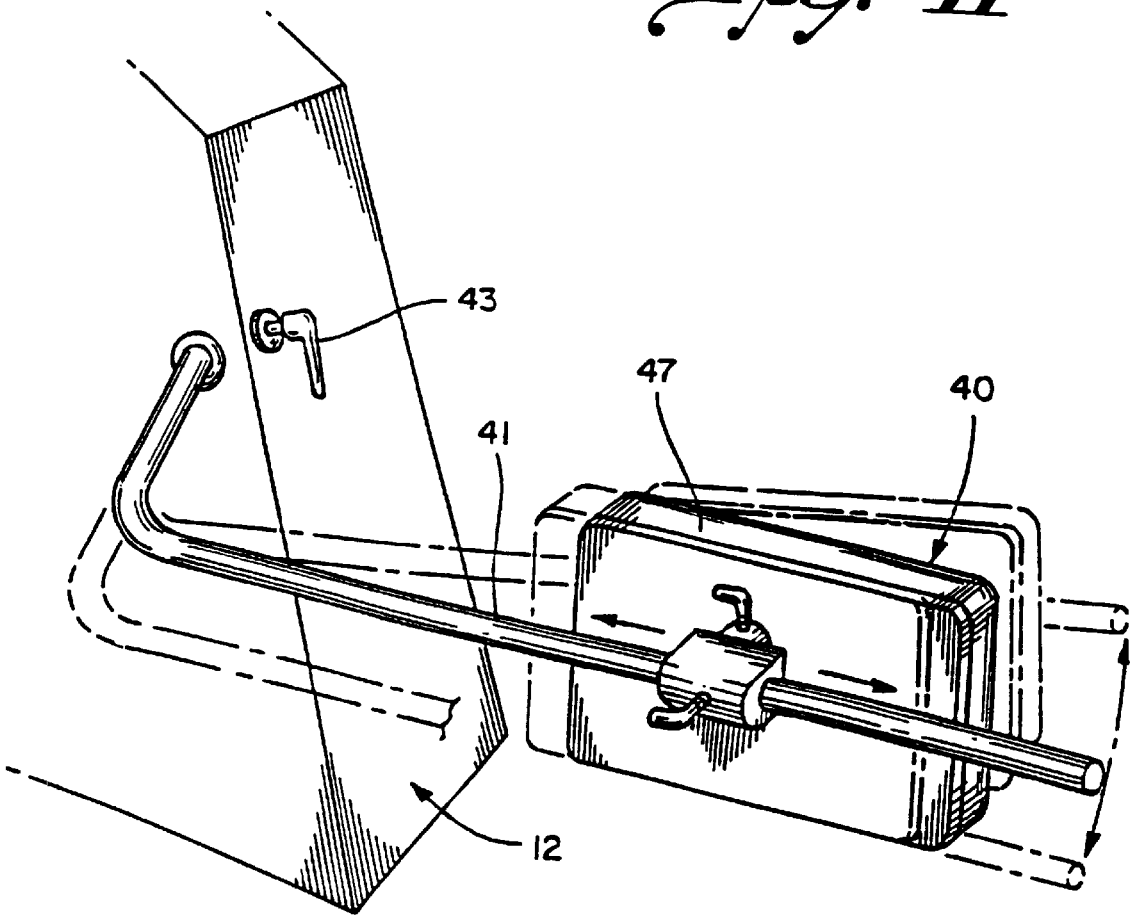
FIG. 12 is a fragmented perspective view of the leg stop according to the present invention.

The base 12 also carries an adjustable leg stop assembly 40 that includes an L-shaped rod having a first leg portion 41 slidably received in the base, as seen in FIG. 5, and locked in position therein by handle operated locking members 43 and 44, and a second leg portion 45 that slidably receives a generally rectangular cushioned leg stop 47. Suitable means are provided for locking the leg stop 47 to the rod leg portion 45, and as seen in FIG. 12, the rod is rotationally adjustable in the base 12 to vary the vertical height of the leg stop 47. The leg stop 47 is designed to limit the rearward movement(a direction away from the target) by engaging the golfer's lower right leg(for righ-handed golfers). This reduces undesirable right leg sway during the back swing.

Figure 9:
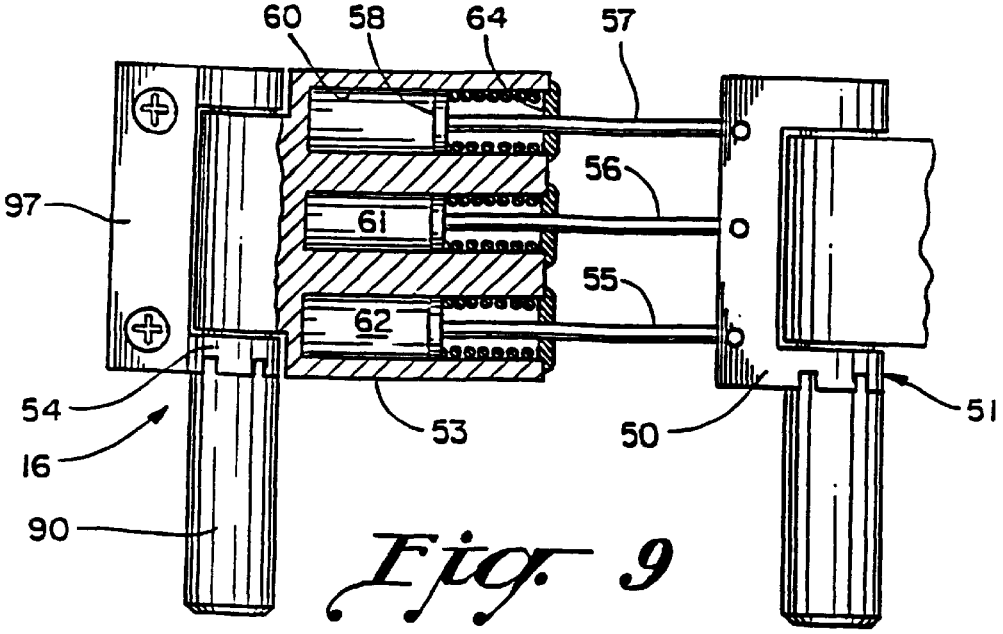
FIG. 9 is a partly fragmented view of the expandable link.

As seen in the top view of FIG. 6, the link assembly 16 includes a head portion 50 pivotally connected to the head 14 by a pivot assembly 51, and an extendable belt portion 53 pivotally connected to the belt by a second pivot assembly 54. The pivot 54 is about three to four inches to the left of the center of the belt assembly back plate 96 as viewed from the top in FIG. 6, for example. Link belt portion 53 extends during the golf swing at appropriate times to achieve the desired spine path. The link assembly 16 is shown in an almost collapsed position in FIG. 8 and an almost fully extended position in FIG. 9. As seen in FIG. 9, the link head portion 50 has three round rods 55, 56 and 57 fixed therein and each has a piston portion 58 slidable in one of the bores 60, 61 and 62. The pistons 58 are biased toward their retracted position by coil compression springs 64. The continuous biasing of the extendable link assembly 16 to its collapsed position offers resistance to extension by the golfer and improved proper muscle development.

Figure 10:
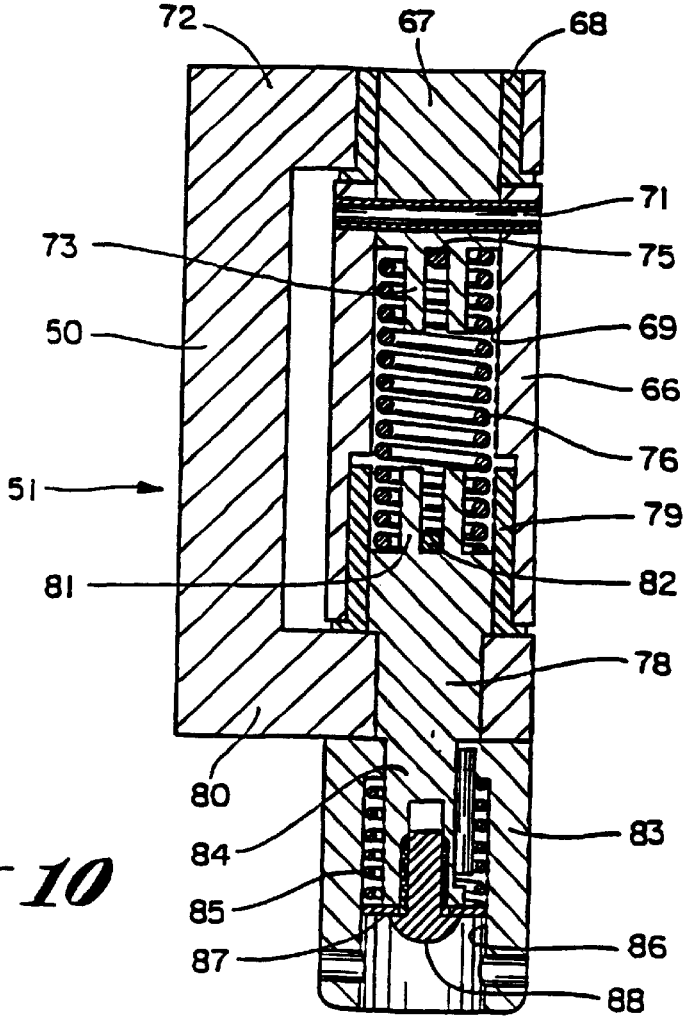
FIG. 10 is a longitudinal section of one of the pivot assemblies for the expandable link taken generally along line 10—10 of FIG. 8.

Both the pivot assembles 51 and 54 have similar adjustable centering springs, one illustrated in FIG. 10, that respectively bias the link 16 to the address position in FIG. 6 parallel to the target line, and bias the belt assembly 18 to the address position. The pivot assembly 51 includes an annular boss 66 fixed to the column head 14. A pivot boss 67, carrying an annular bushing 68, is fixed in the top of the boss 66 by a roll pin 71. The link head portion 50 has an upper arm 72 rotatably mounted on bushing 68. The boss 67 has downwardly projecting spaced tangs 73 that receive upper spring arm 75 of a coil compression spring 76 mounted in bore 69. Tangs 73 hold the upper end of the spring 76 fixed. A stepped lower boss 78 is rotatable in a bushing 79 received in an enlarged lower portion of the bore 69 and it rotatably supports a lower arm 80, which is part of the link head portion 50. The boss 78 has a pair of upwardly projecting tangs 81 that receive a spring arm 82 on the lower end of the coil compression spring 76. An annular hand wheel 83 is keyed to the lower stepped portion 84 of the boss 78 but is slidable on the lower portion to disengage teeth 85 on the upper portion of annular hand wheel 83 that engage in complementary slots 86 in the lower arm 80 to lock the hand wheel 83 in the desired position with respect to the link head portion 50.

The hand wheel 83 is biased upwardly by a coil compression spring 85 in bore 86 that engages a spring seat 87 fixed to the lower end of the boss 78 by pin 88. By rotating the hand wheel 83, the tension of spring 76 can be adjusted as desired to vary the biasing force tending to rotate link head portion 50 to its address position shown in FIG. 6.

The pivot assembly 54 has a similar coil compression spring assembly adjusted by hand wheel 90 to vary the force tending to rotate the belt assembly 18 back to the address position shown in FIG. 6. By varying the biasing forces of the pivot assemblies 51 and 54, the resistance to the swinging motion of the belt assembly 18 can be varied as desired, bearing in mind as discussed above, that muscle memory is enhanced by greater resistance to the swing, which is also a muscle exercise function.

Figure 11:
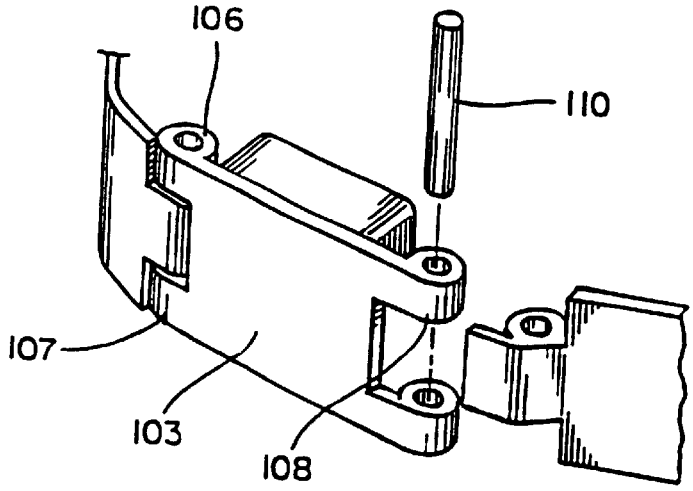
FIG. 11 is a fragmented perspective of several of the links in the hip belt assembly.

As seen in FIGS. 1 and 6, the belt assembly 18 includes a plurality of rigid aluminum links pivoted to one another that carry body engaging pads and a releasable clip assembly 92 carried by flexible belt portions 93 and 94. As seen in FIGS. 1 and 6, the belt assembly 18 includes a U-shaped rigid aluminum back plate 96 fixed to an L-shaped member 97 forming part of the pivot assembly 54 shown in FIG. 9. Back plate 96 carries an elongated pad 99 adapted to engage the golfer's back. Short links 100 and 101 are pivoted to the ends of plates 96 and similar short pivot links 103 and 104 are pivotally connected to links 100 and 101 respectively. The links 100 and 101 are identical and have spaced bosses at one end, and a central boss at the other end, while links 103 and 104 have spaced bosses 106 and 107 at one end and spaced bosses 108 at the other end and are pinned to one another by pivot pins 110, such as illustrated in FIGS. 10 and 11.

Each of the links 100, 101, 103 and 104, have rectangular body engaging pads 111. A pair of longer links 113 and 114 are pivotally connected to links 103 and 104 and have elongated body engaging pads 115 thereon, and these links carry the flexible belt portions. 93 and 94 respectively.

Figure 13:
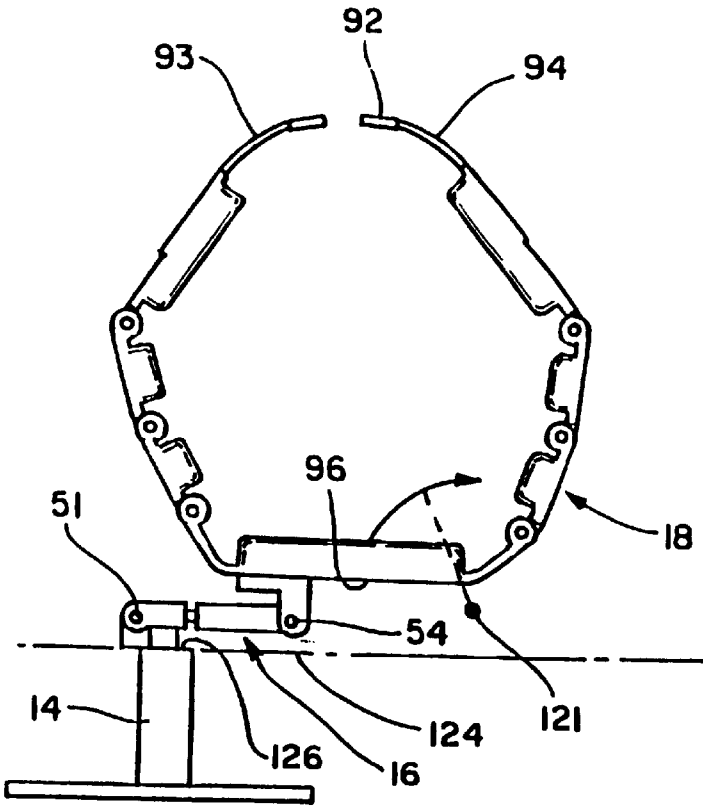
Figure 18:
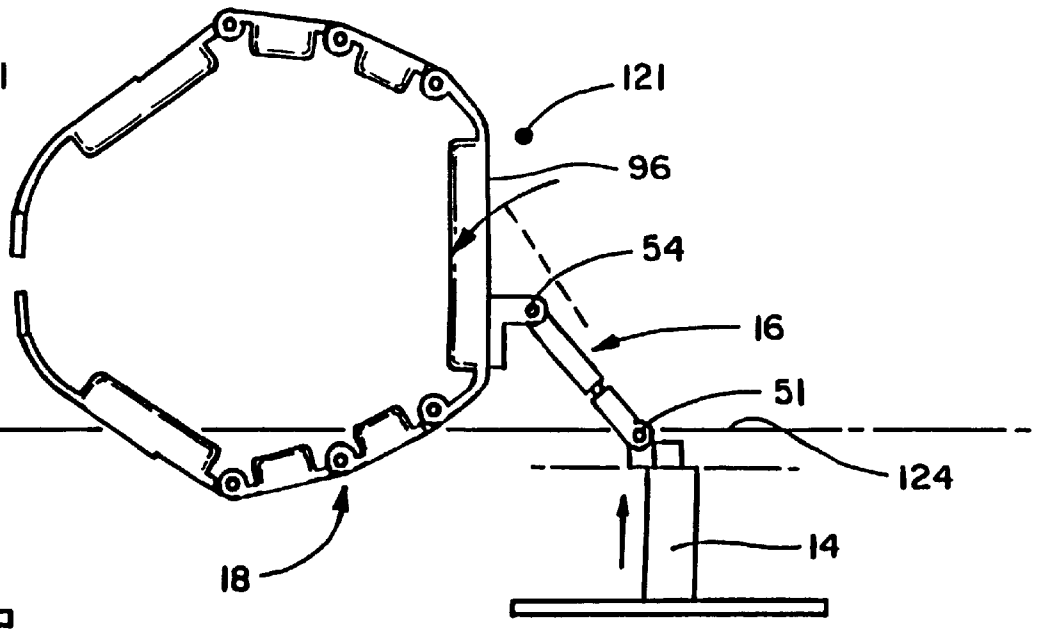
Figure 19:
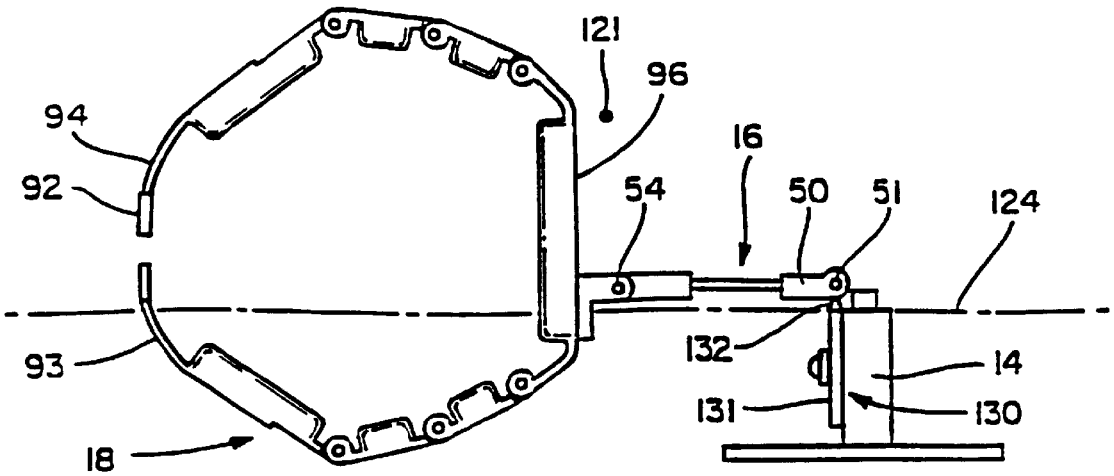

Reference will now be made to FIGS. 13 to 19, for a sequence of operation of the present golf swing training system beginning with the address position in FIG. 13 and ending with the right foot step over position illustrate din FIG. 19. Reference will also be made to certain other figures during this explanation. It should be understood that some of the details of the base and column, as well as the link assembly 16 and the belt assembly 18 have been eliminated for brevity and lack of confusion in these figures, but the details are believed shown clearly in FIGS. 1 to 12 above.

Also, the human form has not been illustrated in FIGS. 13 to 19 so the form does not obscure the mechanical parts of the system, but it should be understood that these positions are achieved with the belt assembly 18 around the golfer's hips and the clasp 92 adjusted and clamped.

The arrows depicted adjacent column head 14 in FIGS. 14, 15, 16, 17, 18, and 19 depict the movement of the column head and the column 13 about their pivot shaft 31. This movement, as noted above, is movement of the column assembly 13 in a plane perpendicular to the target line. Also, the reference numeral 124 in FIGS. 13 to 19 represents a fixed vertical plane parallel to the target line and coincident with forward surface 126 of the column head 14 in the address position illustrated in FIG. 13. Note, for example in FIG. 14, the forward surface 126 of the column head 14 is shifted away from the reference plane 124 representing a counter-clockwise rotation of the column about pivot shaft 31 as viewed in FIG. 3, for example.

Initially, the height of the belt assembly 18 is adjusted utilizing the locking device 30 in the column assembly 13. The top of the belt assembly 18 should be approximately level with the top of the golfer's pelvic bone, and the belt assembly 18 should be secure around the golfer by adjusting the straps 93 and 94. Note that when the golfer straps in belt assembly 18, the column assembly 13 is in its vertical position biased thereby the biasing devices 33 and 34. After this is completed, the golfer bends at the knees to the appropriate address position and addresses an actual golf ball, also in the appropriate position on the mat(not shown) adjacent the training system 10. This movement rotates the column assembly 13 toward the ball, causing it to assume approximately the position shown in FIGS. 3 and 4. And in this position note that the belt assembly 18 is on somewhat of an angle as are, of course, the golfer's hips in the proper address position.

Reference number 121 in FIGS. 13 to 19 indicates the first axis referred to above and pivot 51 is the second axis above and both define the centers for the correct arcs of the spine during the swing. As noted above, in the back swing and return to impact, the belt assembly 18 encourages the body to pivot about axis 121 and during follow through, to the FIG. 18 position. completing follow through, the belt assembly 18 encourages the golfer to pivot generally about axis 51.

In the address position of FIG. 13, the link assembly 16 is completely collapsed, the link assembly 16 is parallel to the target line, the column head reference surface 126 lies in the reference plane 124 and the belt assembly back plate 96 is parallel to the target line.

Figure 14:
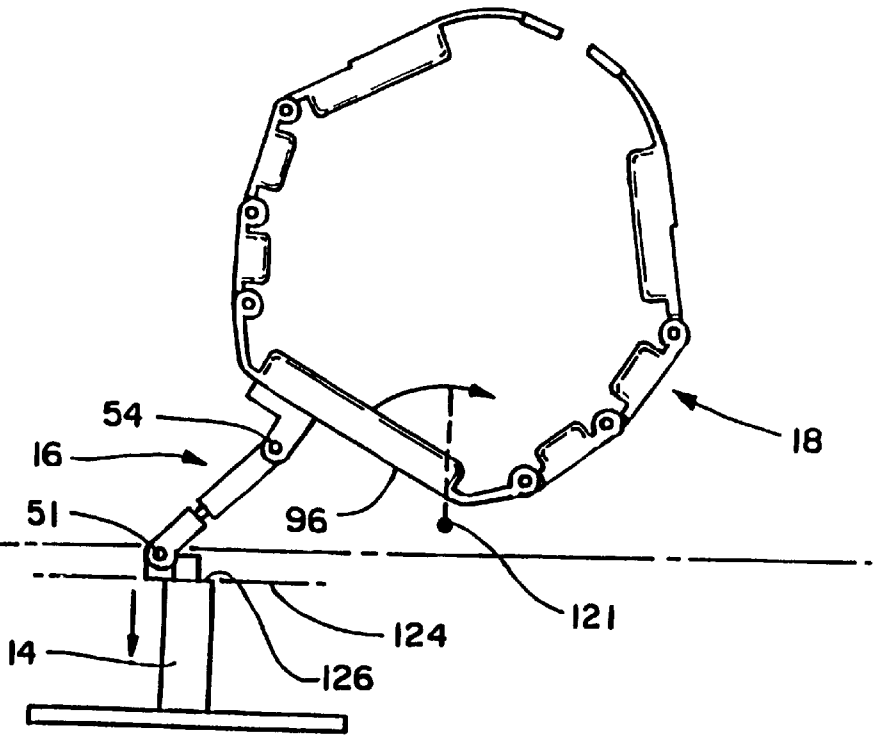

Midway through the back swing, as illustrate din FIG. 14, the link assembly swings counter-clockwise from its address position. In this position the link assembly 16 assumes a position of about 45 degrees counter-clockwise with respect to reference plane 124. At the same time the belt assembly rotates clockwise about pivot 54 about 80 degrees.

Figure 15:
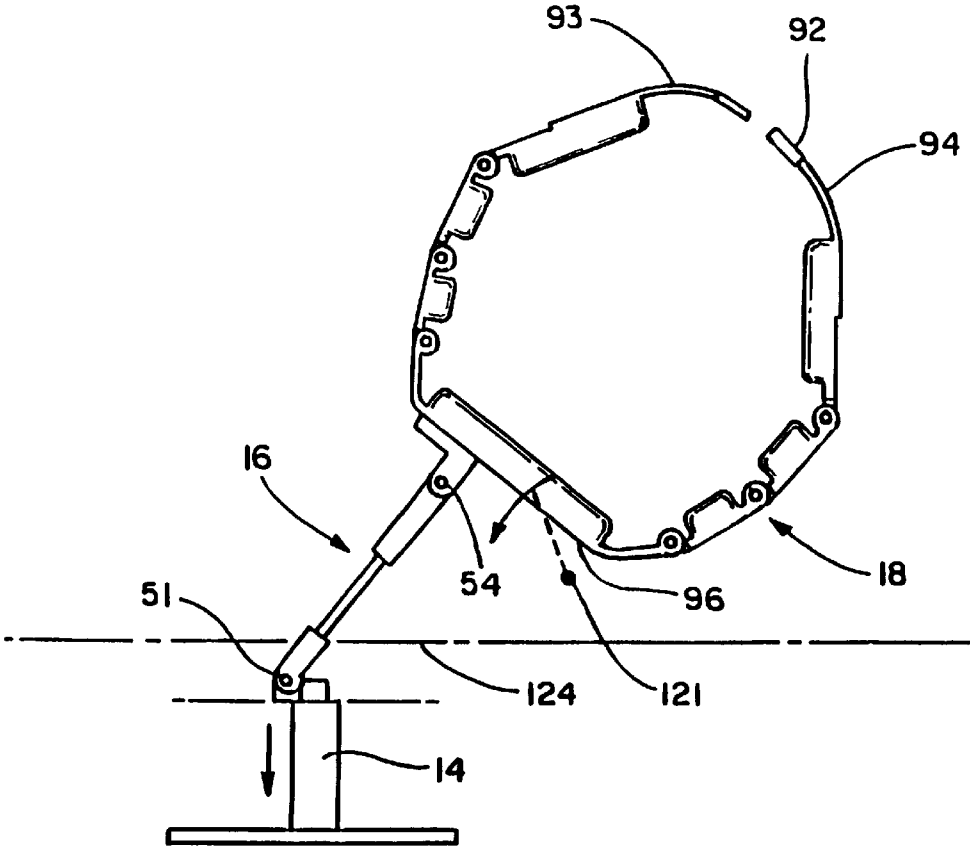

The completed back swing position is illustrated in FIG. 15, and here the link assembly 16 is fully extended and is rotated further counter-clockwise about pivot 51 about 15 degrees, and at the same time the belt assembly 18 is rotated clockwise about pivot 54 about 10 or 15 degrees further than the FIG. 14 position.

Figure 16:
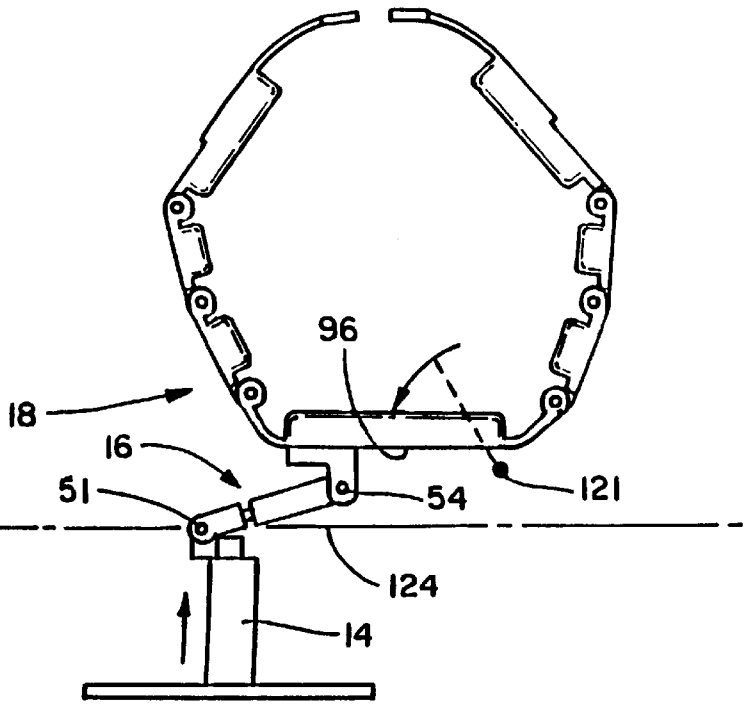

As the golfer initiates the downswing by transferring weight to the left foot toward the ball impact position illustrated in FIG. 16, clockwise pivotal movement of the belt about axis 51 begins, and linkage 16 returns to an almost collapsed position about 15 degrees counter-clockwise from the address position. The column head in FIG. 16 moves toward the ball, as depicted, for example, by the arrow adjacent the column head 14 in FIG. 16. The column head moves toward and away from the ball to adjust for the posture of the golfer during the swing. In this ball impact position, the belt assembly back plate 96 is parallel to the target line and the plane 124.

Figure 17:
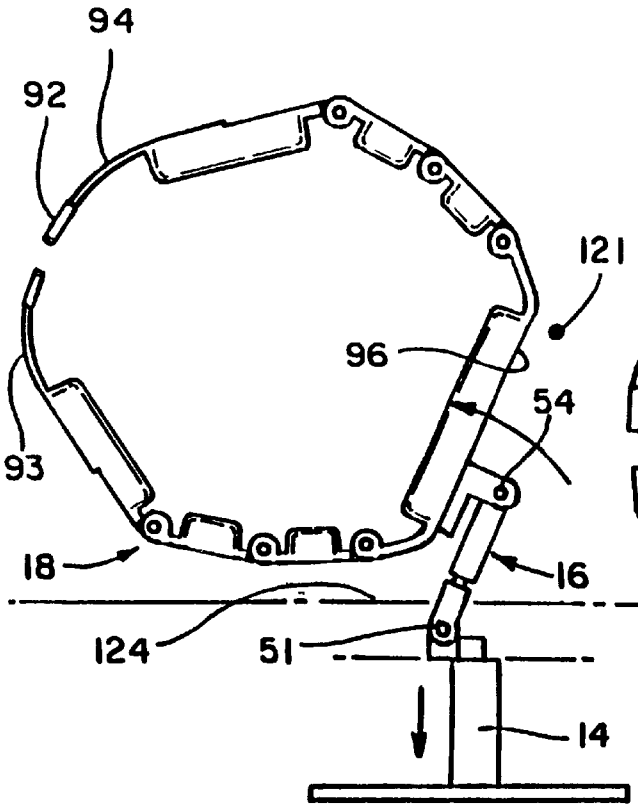

As the golfer swings through the ball at impact, the belt assembly 18 pivots about axis 51 instead of axis 121 with the link assembly 16 remaining collapsed, as depicted in FIG. 17, tending to move the belt assembly 18 toward the ball relative to the column head 14. At the same time, in this intermediate follow through position, link assembly 16 is about 90 degrees counter-clockwise with respect to plane 124, and the belt assembly back plate 96 is parallel to the link assembly 16. This movement encourages the golfer to pivot about axis 51.

The completed follow through is depicted in FIG. 18 where the link 16 is approximately 130 degrees clockwise with respect to plane 124, the linkage assembly 16 remains fully collapsed, and the belt assembly back plate 96 pivots clockwise with respect to the link assembly 16 about pivot 54 from the FIG. 17 position about 50 degrees. Note from FIGS. 17 and 18, that while the belt assembly 18 pivots about axis 51, the golfer's left side moves toward the target.

As a training aid, after completion of the follow through in FIG. 18, the golfer is encouraged to step over the left foot with the right foot toward the target, and this position is illustrated in FIG. 19 and is accommodated by the full extension of link assembly 16.

Figure 4:
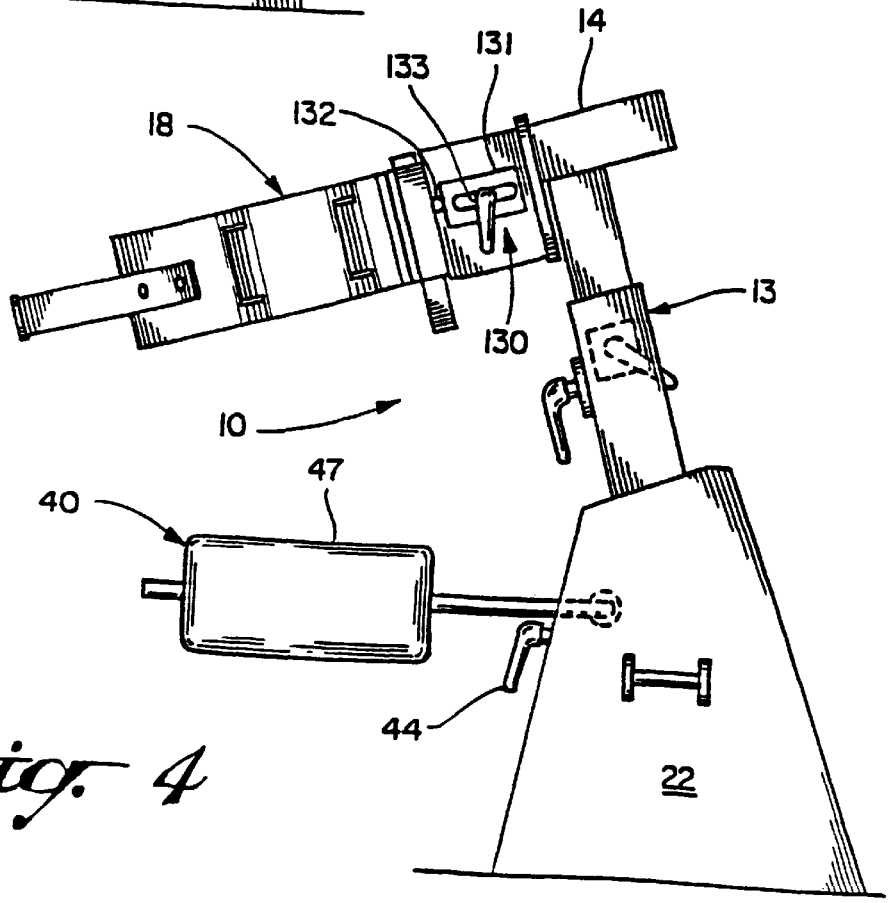
FIG. 4 is a right side view of the golf swing training system illustrated in FIGS. 1 to 3.

As seen in FIGS. 4 and 10, an adjustable stop mechanism is provided for limiting rotational movement of the link head portion 50. Adjustable stop 130 includes a slide 131 having a rubber stop member 132 at its forward end and a rotational clamp 133 extending through a slot in the slide 131. Stop member 132 engages the side of the head link portion 50, as seen in FIG. 19. The stop 132 is adjustable toward the ball in the plane of FIG. 19 and limits, if desired, rotation of link head portion 50 to less than the 180 degree position it has with respect to the reference plane 124 in FIG. 19. This limiting action may be desirable in cases where the right foot step over described with respect to FIG. 19 is not desired, or in cases where the pupil rotates his or her hips too far to the left on follow through.

Now turning to the embodiment illustrated in FIGS. 1 to 31, it should be understood that this embodiment is not disclosed in the parent application, U.S. Ser. No. 09/237,572, but that it has certain common aspects with the Swing Training System disclosed in FIGS. 1 to 19, which constitute the embodiment disclosed in the parent application. The embodiment in FIGS. 20 to 31; namely, the Swing Training System, disclosed and shown therein, seeks to improve upon the FIGS. 1 to 19 embodiment by providing a mechanical system that more closely approximates the geometry forming the objectives for the swing system in the parent application, and in some cases, the swing system shown in the parent application was deficient in achieving those objectives, although this statement is not to denigrate the basic principles of the Swing Training System shown in the parent application.

The FIGS. 20 to 31 embodiments of the Swing Training System includes a dual pivot modification that respositions the two pivot points with adjustability between the two pivot points to more closely approximate the desired golfer swing geometry.

With a right-handed golfer, for example, the right or back pivot(forward being toward the target and back being away from the target), is now positioned directly to the outside and to the rear of the right hip joint. The left pivot(the pivot toward the target referred to as the first pivot axis) is adjustable and can and should be positioned to the outside and to the rear of the left hip joint. The rear portion of the belt assembly has been repositioned (compared to the FIGS 1 to 19 embodiment), to be aligned with the center line of the rear pivot (second pivot axis). The pivot points are mounted as closely to the belt assembly as mechanically possible. This acts to keep the hips in front of and in the proper line during the backswing.

The first pivot axis is adjustable by movement of a saddle along the pivot bar until it is properly positioned so that the golfer's left hip is locked in place in the appropriate position relative to the first axis.

Referring to FIGS. 20 to 31 generally, a golf training system 210 is illustrated consisting generally of the base 212, a vertically extendable column assembly 213 pivotally mounted in the base 212, a column head assembly 214 fixed to the top of the column assembly 213, a pivot arm assembly 216 carried by the head 214, and pivotally supporting a hip belt 218, which is adapted to be strapped about the golf pupil'ships. Base 212 has a truncated pyramidal shape including front wall 220, side walls 221 and 222, a rear wall 224, a bottom wall 225, and a top wall 226, through which pivotal column assembly 213 projects.

Figure 21:
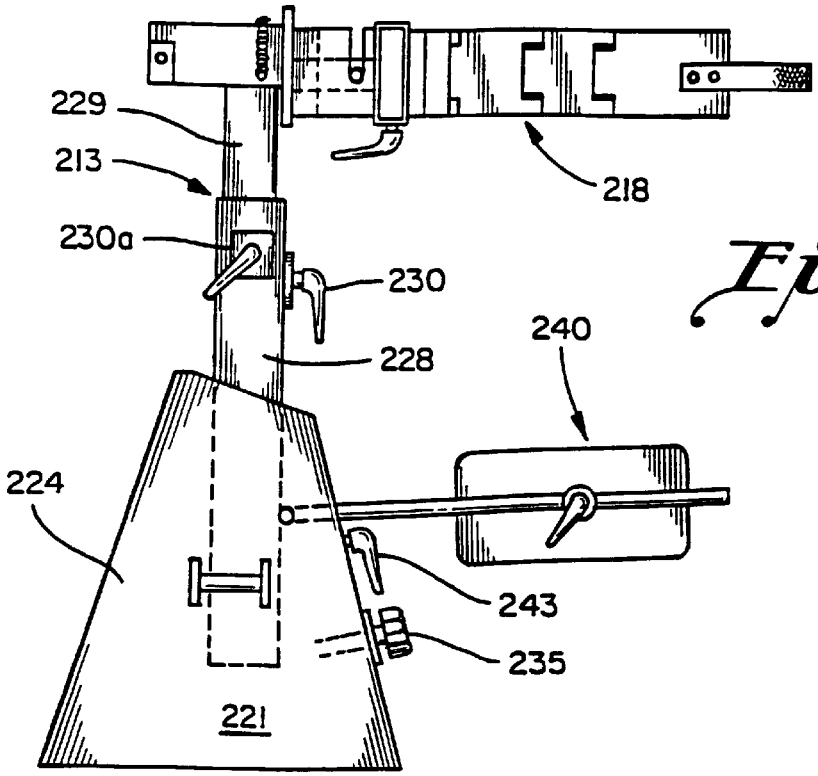
FIG. 21 is a left side view of the swing training system illustrated in FIG. 20.
Figure 22:
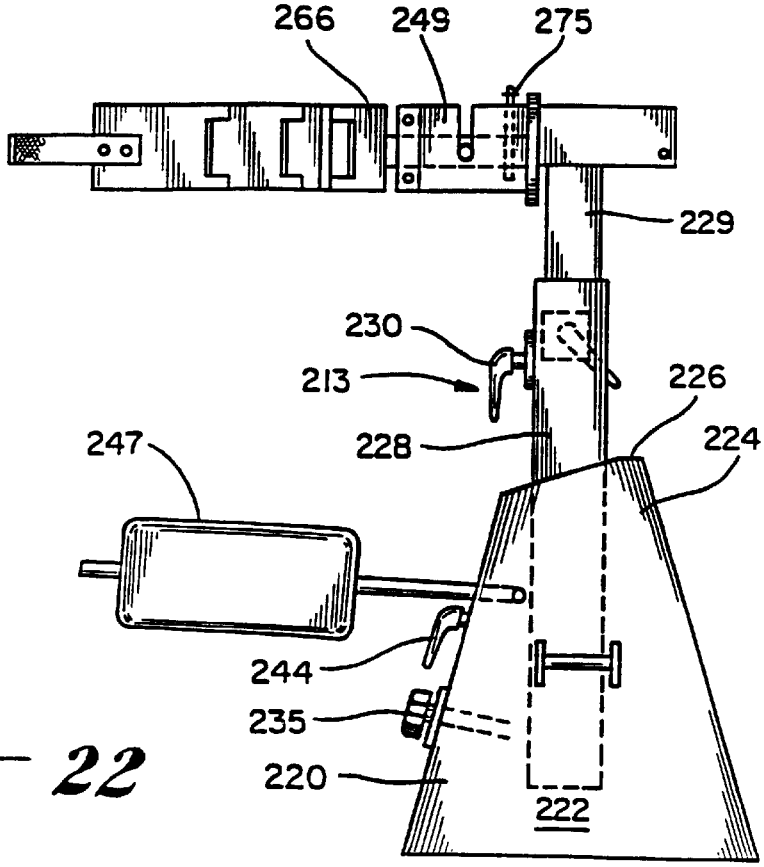
FIG. 22 is a right side view of the swing training system illustrated in FIGS. 20 and 21.
Figure 24:
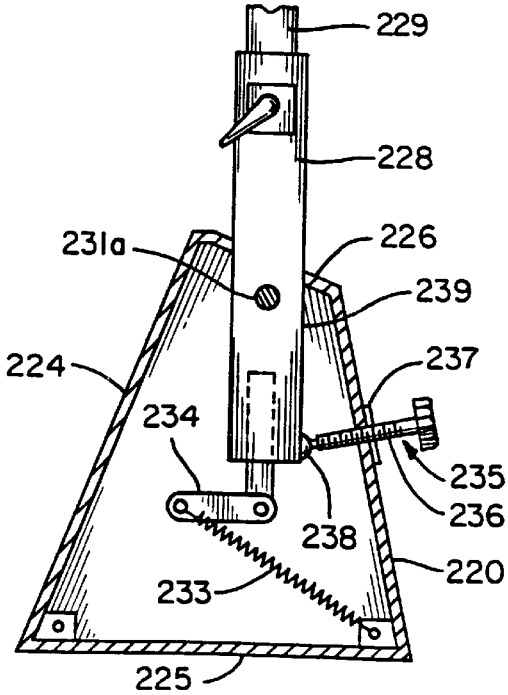
FIG. 24 is a fragmented section of the base of the swing training system illustrated in FIGS. 21 to 23.

As seen in FIGS. 21, 22, and 24, the column assembly 213 includes a lower channel member 228, generally rectangular in cross section that slidably receives an inner channel member 229 that is vertically adjustable in the lower channel member and locked in position by handle operated stops 230 and 231. In this way, the belt assembly 218 can be adjusted to the appropriate hip height of the golfer. The lower column channel 228 is pivotally mounted on a rod 231*a*, as seen more clearly in FIG. 24. The lower column 228 is biased toward its vertical position by a coil compression spring 233 fixed in the base to the corner of forward wall 220 and bottom wall 225 and connected at its upper end to a pair of arms 234 connected to the bottom of the lower channel section 228. Spring 233 biases the upper end of column 228 and the belt assembly 218 away from the ball; that is, in a direction perpendicular to the target line away from the position of the ball. The pivoting in the column assembly 213 about rod 231 enables the belt to move in a plane transverse to the target line toward and away from the ball. As seen more clearly in FIG. 24, a stop assembly 235 limits the pivotal motion of the column assembly 213 away from the ball. The stop assembly 235 includes a hand-wheeled threaded member 236 threaded into a plate 237 carried by the forward end of the forward wall 220 that carries a swivel stop 238 at its end engaging forward surface 239 of lower column member 228.

The pivotal movement of the column 213 about the pivot 231*a* is to permit the golfer at address to assume his or her normal squat position, rocking the lower end of column 213 somewhat away from the stop 238, as adjusted by the golf professional. However, once the appropriate address position is achieved, the stop 238 is adjusted in engagement with the forward surface 239 of lower column member channel 228 which prevents the column 213 and the golfer's hips from moving away from the ball during the entire golf swing.

Figure 23:
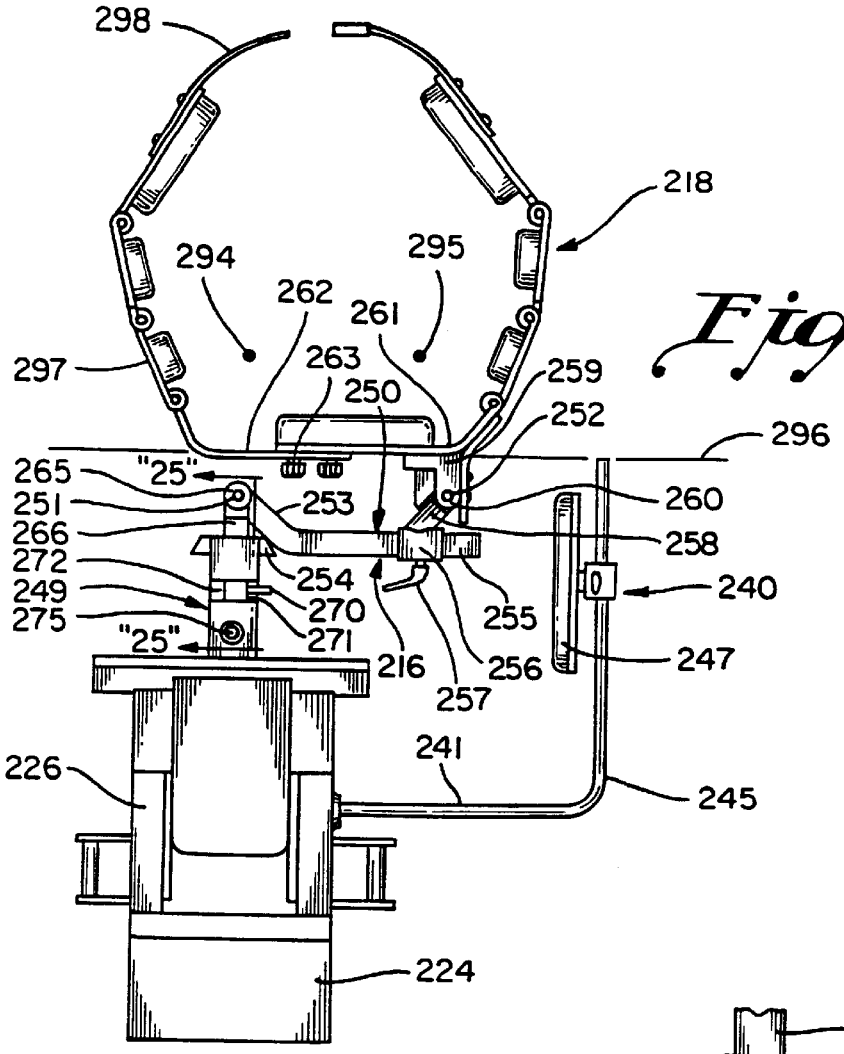
FIG. 23 is a top view of the swing training system illustrated in FIGS. 20 to 22.

The base 212 also carries an adjustable leg stop assembly 240 seen in FIGS. 21 and 23, for example, that includes an L-shaped rod having a first leg portion 241 slidably received in the base, and locked in position by handle operated locking members 243 and 244, and a second leg portion 245 that slidably receives a generally rectangular cushion leg stop 247. Suitable means are provided for locking the leg stop 247 to the rod leg portion 245, and as seen in the drawings, the rod is rotationally adjustable in the base 212 to vary the vertical height for the leg stop 247 and the base 212. The leg stop 247 is designed to limit the rearward movement(a direction away from the target) by engaging the golfer's lower right leg(for right-handed golfers). This reduces undesirable right leg sway during the backswing.

Figure 20:
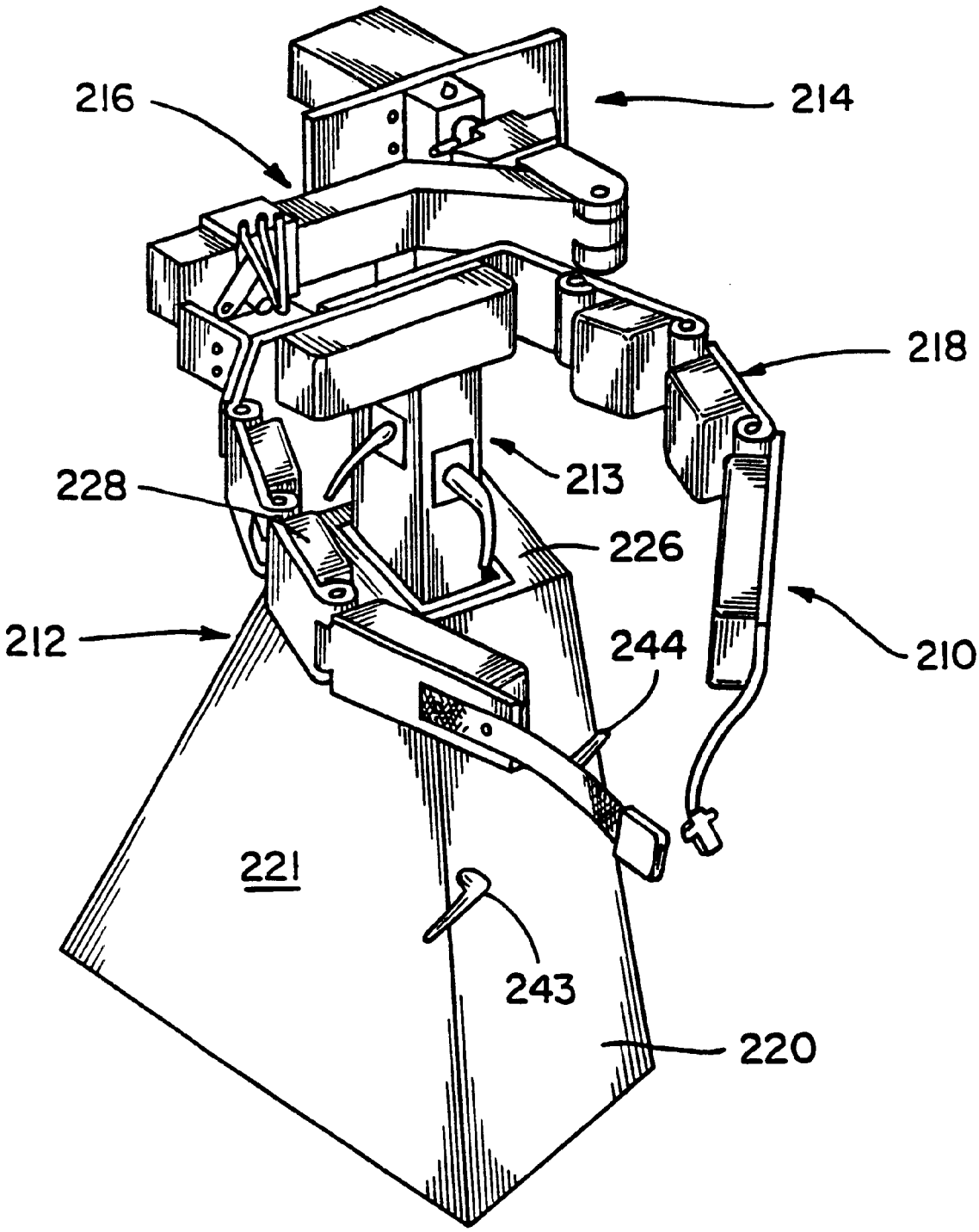
FIG. 20 is a top perspective of swing training system not disclosed in the parent application.

As seen in FIGS. 20 and 23, and other FIGS. as well, the pivot arm assembly 216 includes a pivot arm member 250 connected at a first pivot axis 251 to the column assembly head member 249, and is connected at a second pivot axis 252 to the belt assembly 218.

The pivot arm 250 has a first portion 253 adjacent pivot 251 that angles approximately 45 degrees backwardly when viewed from the top in FIG. 23 from the pivot 251, and it engages a stop 254 that limits backward movement of the pivot arm 250 from its FIG. 23 position to prevent the arm 250 from moving rearwardly from that position which, of course, is the address position of the belt assembly 218.

The arm 250 has a second straight portion 255 that slidably receives a rectangular saddle 256 locked in position along arm portion 255 by locking assembly 257.

The saddle 256 is connected to the right rear side of the belt assembly 218 by an integral post 258 that angles 45 degrees rearwardly and carries at its end a pin 260 forming the pivot axis 252 with L-shaped bracket 259 fixed to saddle rear back engaging bracket 261.

The belt assembly 218 includes the rear bracket 261 that is clamped to bracket 262 by fasteners 263 that enable the lateral expansion and contraction of the brackets 261 and 262 relative to each other to accommodate the belt assembly 218 to different sized golfers.

After this adjustment is made to fit the golfer's anatomical hip configuration, the saddle 256 is loosened and adjusted along pivot arm portion 255 so that the golfer's left hip joint is just inside and toward the ball from the pivot axis 251.

Figure 27:
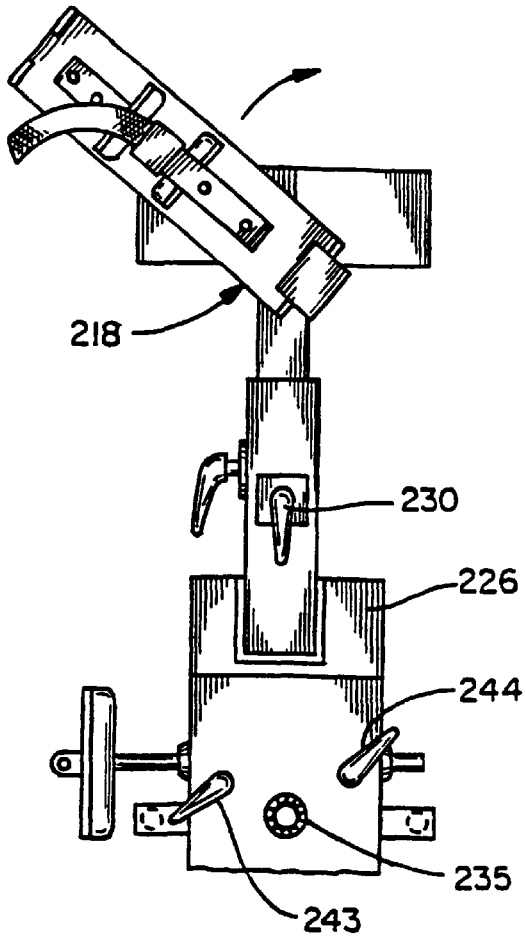
FIG. 27 is a front view of the FIG. 20 embodiment with the belt assembly rotating toward the left hand position.
Figure 28:
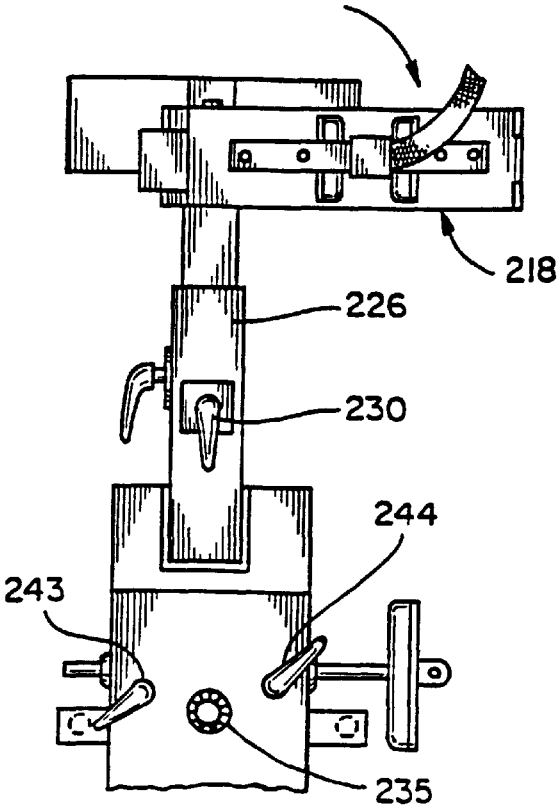
FIG. 28 is a front view similar to FIG. 27 with the belt assembly fully rotated to its left hand position.

The pivot arm 250 is connected to the column head 249 to enable the belt assembly to be rotated from the FIGS. 21 and 23 positions through the FIG. 27 position to the FIG. 28 position to also accommodate left-handed golfers. The left-hand rotation position of the assembly is illustrated also in the top view of FIG. 29.

Toward these ends, and as seen in FIGS. 23, 25, and 26, the pivot arm portion 253 carries a pin 265 at its distal end forming the first pivot axis 251 with boss 269, which is the pivotal connection of the pivot arm 250 with the column head 249. Also, the boss extension 266, as seen in FIG. 25, has an integral rearwardly projecting shaft 267 that is rotatably mounted in column head 249 in through bore 268. The shaft 267 carries a radial pin 270 that engages column head radial surfaces 271 and 272 respectively to define the right hand and left hand positions for the hip belt assembly 218. In use, the operator releases a locking pin 275 in head 249 which extends into a diametral hole 276 in shaft 267 enabling the operator to grasp the belt assembly 218 and rotate it from its FIG. 23 position through its FIG. 27 to its FIG. 28 positions where pin 270 engages surface 272 and then re-enters pin 275 into bore 276 locking the belt assembly in the left hand mode position.

As seen in FIG. 26, a plurality of additional stops are provided for limiting movement of the belt assembly 218 relative to the pivot arm 250.

A first L-shaped stop 278 is fixed to belt bracket 261 and bracket 259 and has an outwardly extending portion 279 that engages bracket surface 280 on post 258 as the belt assembly 218 rotates counter-clockwise as viewed from the top in FIG. 23 during the backswing.

Figure 30:
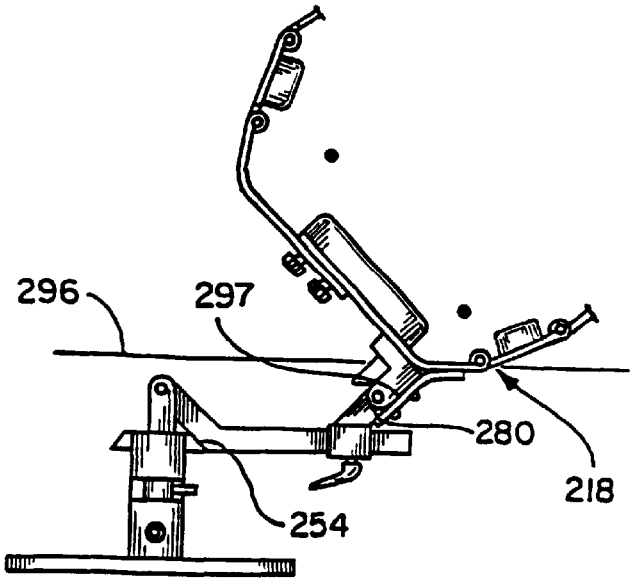
FIG. 30 is a continuation of FIG. 23 from its address position to the maximum backswing position.

As seen in FIG. 30, which is the limit of the backswing for the belt assembly 218, the stop portion 279 engages surface 280 and prevents further rotational movement backwardly from the FIG. 30 position. This configuration is designed to limit the hip pivot during the backswing to about 45 degrees.

An additional stop 282 is fixed to bracket 259 and has a 45 degree angle stop surface 284 that engages surface 285 on post 258 that limits the rotational movement of the belt assembly 218 during the downswing to the address position shown in FIGS. 23 and 26. That is, during the downswing, the belt assembly 218 pivots about the second pivot axis 252 until stop 284 engages stop 285 at substantially the address position illustrated. Thereafter, the bracket 259 and hence the belt assembly 218 is prevented from further pivotal motion about the second axis 252 and hence the belt assembly 218 is locked to the pivot arm 250 during the remainder or follow through of the golf swing, and during that period, pivotal movement is limited to movement of the belt assembly 218 and the pivot arm 250 about the first pivot axis 251.

The belt assembly 218, in addition to brackets 261 and 262, consists of a a plurality of cushioned links 297 and flexible end members 298 that are connected together by conventional seat belt-type connectors similar to that shown in the FIGS. 1 to 19 embodiment.

Viewing FIGS. 23 and 30, points 294 and 295 represent vertical axes extending through the right hip socket and the left hip socket of the golfer after the belt brackets 261 and 262 have been adjusted with fasteners 263 to accommodate the anatomy of the golfer. This places the second pivot axis 252 just outside(rearward relative to the target) and back from axis 295. Saddle 256 is then adjusted on arm portion 255 so that the first pivot axis 251 is just outside and somewhat to the back of the golfer's left hip socket axis 294. Hip socket axes 294 and 295 are defined simply by vertical lines passing through the anatomical hip socket assembly.

Also depicted in FIGS. 23 and 30 is a vertical plane 296 which is defined as a vertical plane parallel to and spaced from the target line engaging the rear buttocks of the golfer at the address position. As seen in FIG. 30, which depicts the maximum hip rotational position for the belt 218, no part of the hip area goes behind(away from the ball) the plane 296.

As seen in FIG. 26, a plurality of elastomeric bands 290 and 291 are stretched between a pin 292 on bracket 254 and selectively on pins 293, 294 and 295 on saddle 256 to bias belt assembly 218 to its address position and provide back-swing resistance that is adjustable by band position.

Referring to FIGS. 33 to 49, a further improved freestanding golf training system 310 is illustrated consisting generally of a base assembly 312, a column assembly 313, a column head assembly 314, a pivot arm assembly 316, and a hip belt assembly 318.

Figure 33:
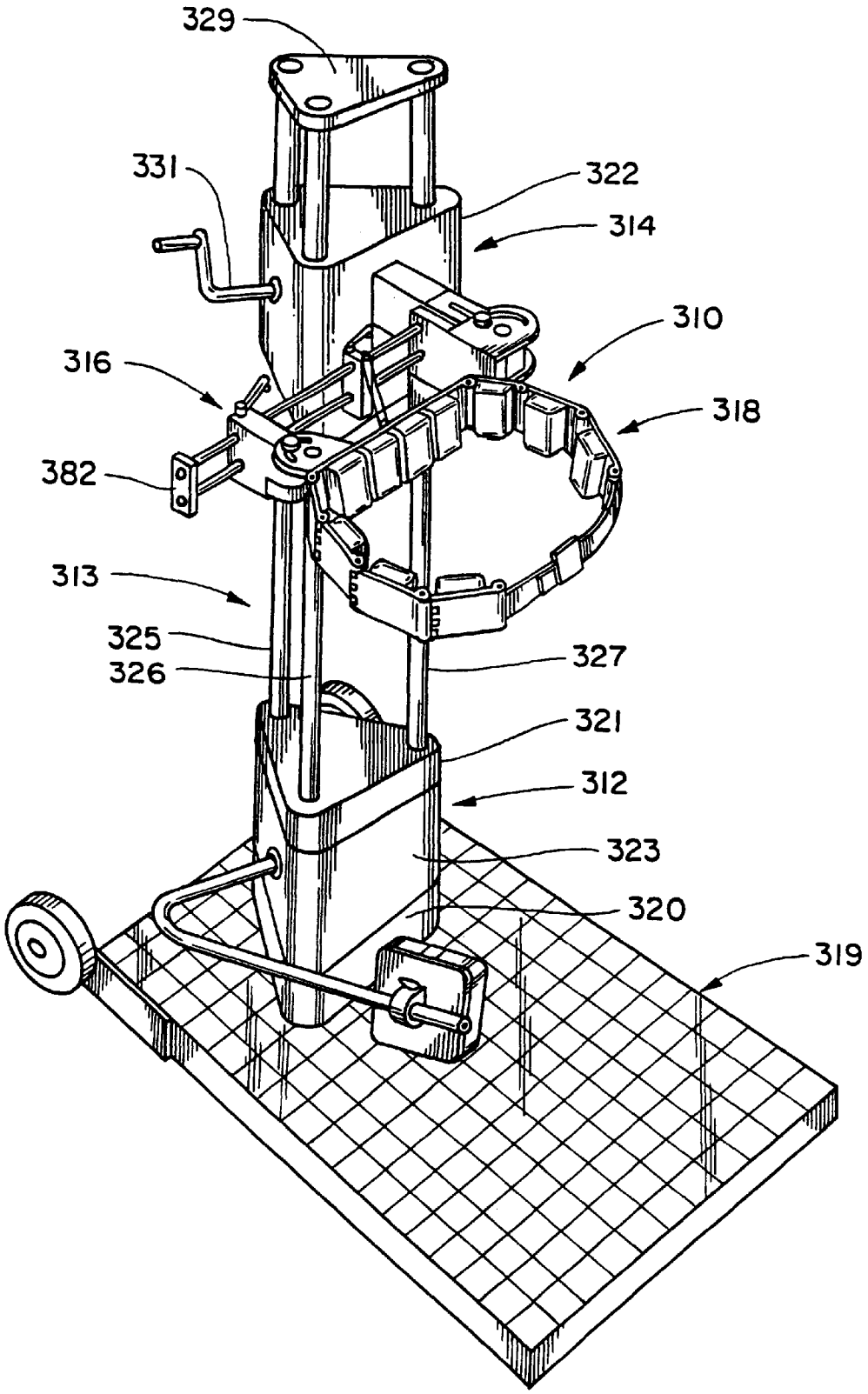
FIG. 33 is a top perspective of a swing training system not disclosed in the parent application.

The base assembly 312 is illustrated in FIG. 33 as being attached to a wheel mat 319 on which the golfer stands and actually impacts golf balls resting on a tee on the mat assembly or directly on the mat.

Figure 40:
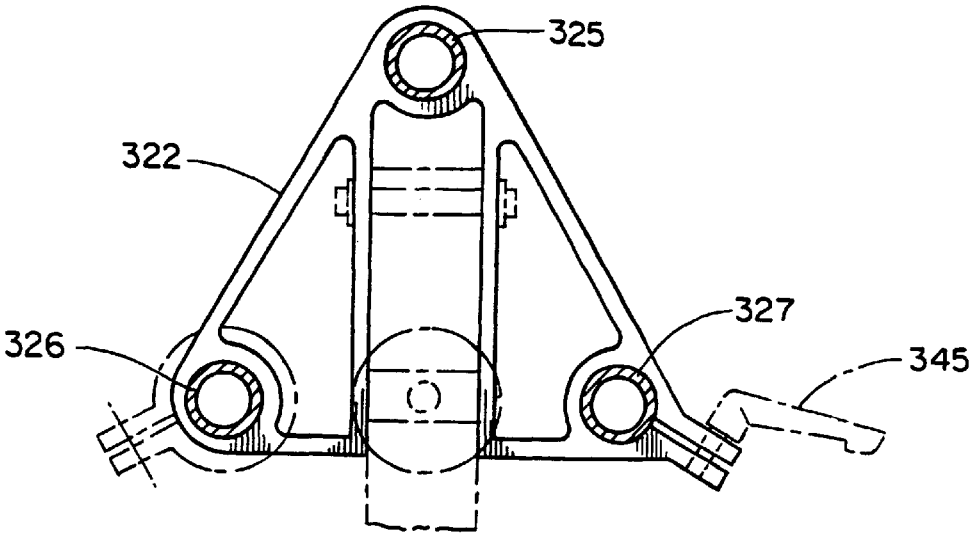
FIG. 40 is a top view of the column slide illustrated in FIG. 33.

The base assembly 312 includes a pair of aluminum extrusions 320 and 321 that are similar in cross section to column slide 322 illustrated in FIGS. 33 and 40.

A sheet metal cover 323 extends between the extrusions 320 and 321. Optionally, this base assembly 312 could be all one extrusion.

The extrusions 320 and 321 support tubular rods 325, 326, and 327 that define the column assembly 313.

The upper ends of the rods 325, 326, and 327 are held in position by another extrusion 329 similar to extrusions 320 and 321.

Figure 34:
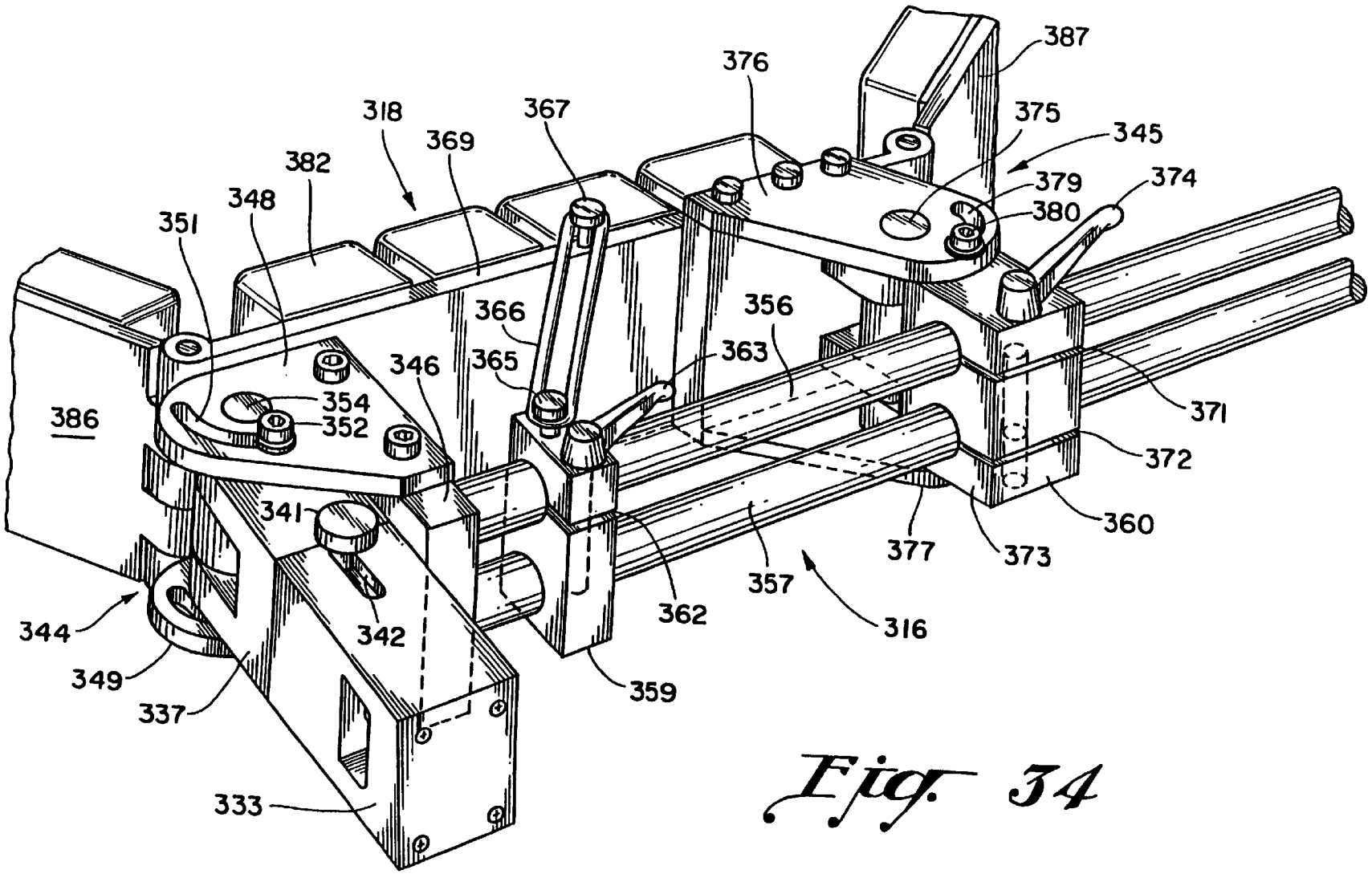
FIG. 34 is a rear perspective of a pivot assembly and fragmented belt assembly of the swing training system illustrated in FIG. 33.
Figure 36:
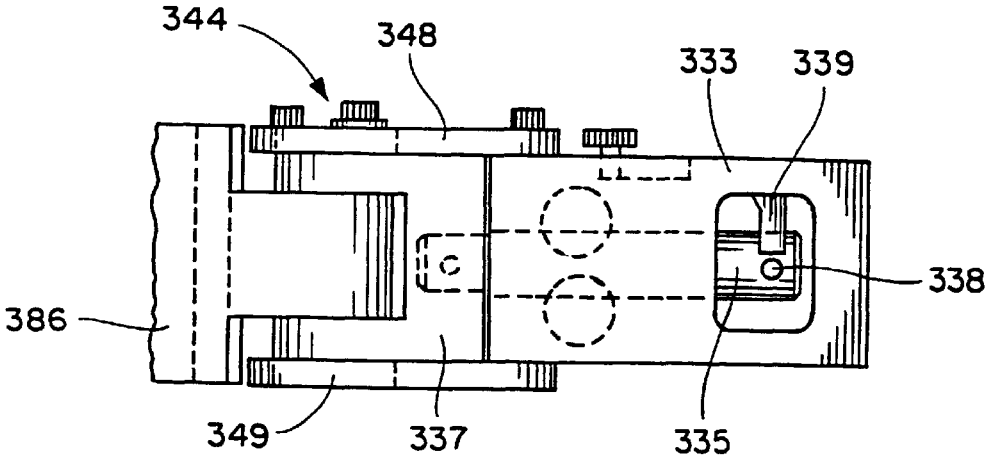
FIG. 36 is a right side view of the pivot assembly and belt assembly illustrated in FIG. 35.
Figure 37:
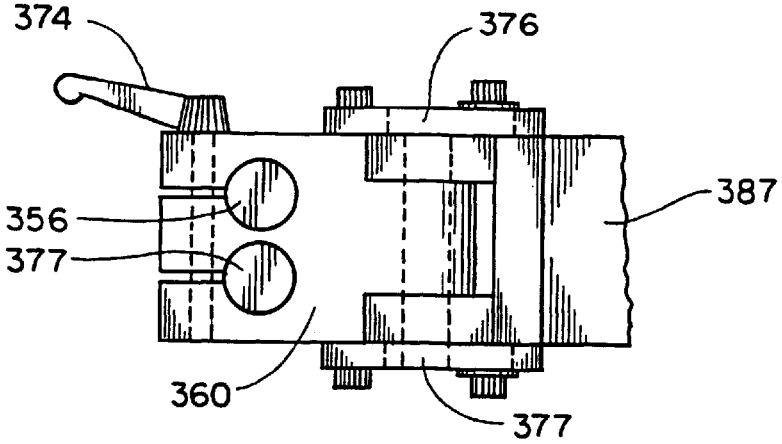
FIG. 37 is a left side view of the pivot assembly and belt assembly illustrated in FIG. 35.
Figure 38:
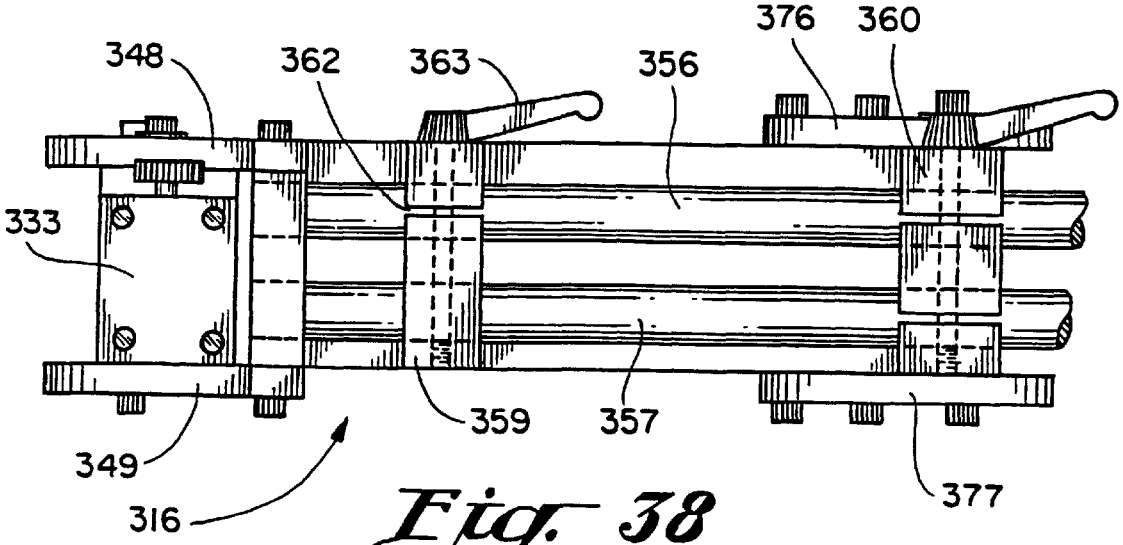
FIG. 38 is a rear view of the pivot assembly and belt assembly illustrated in FIG. 35.
Figure 39:
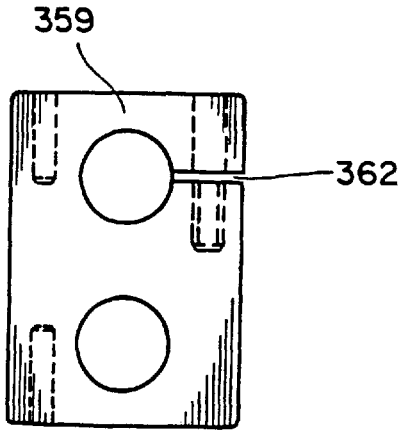
FIG. 39 is a sub-assembly view of the tension slide illustrated in FIGS. 35 to 38.
Figure 41:
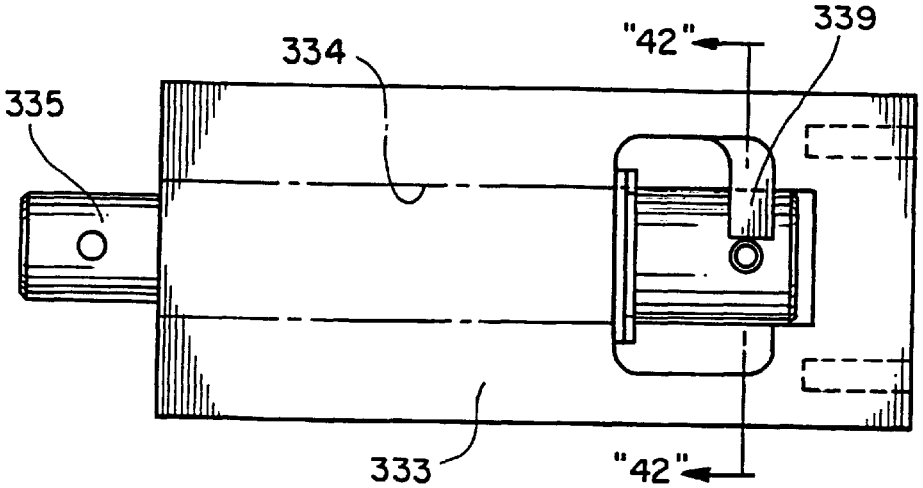
FIG. 41 is a sub-assembly view of the belt rotation mechanism illustrated in FIG. 34.
Figure 42:
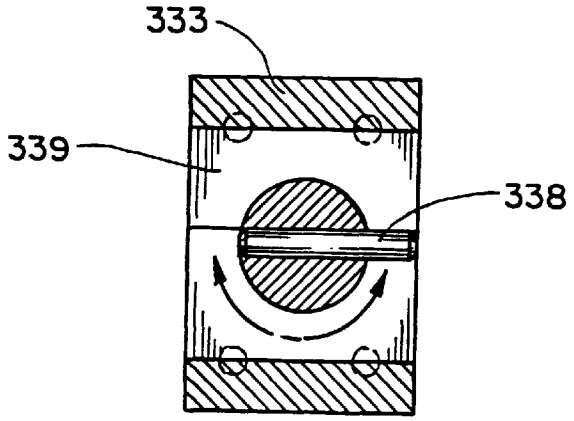
FIG. 42 is a cross section of the belt rotation mechanism taken generally along line 42—42 of FIG. 41.

While not shown in the drawings, the slide 322 forming part of the column head assembly 314 can be vertically adjustable on the rods 325, 326, and 327 by a rack and pinion assembly that includes a crank 331 connected to and driving the pinion in the rack and pinion assembly. The rack included in this assembly, also not shown in the drawings, is fixed to one of the rods 325, 326, and 327, making vertical adjustment of the column assembly 314, the pivot assembly 316, and the belt assembly 318 quite easy. As seen in FIGS. 34, 36, and 41, the column head assembly 314 includes a block 333 having a bore 334 therein that rotatedly receives a pivot shaft 335 that permits the pivot assembly 316 and the belt assembly. 318 to be rotated 180 degrees from the position illustrated in the drawings for left-handed golfers. Viewing FIG. 33, this permits the pivot assembly 316 and the belt assembly 318 to be swung downwardly in a counter-clockwise direction 180 degrees.

The projecting end of shaft 335 in FIG. 41 is received in a complementary bore in pivot assembly block 337, as seen in FIG. 34, and is pinned therein so that shaft 335 is rotationally fixed to block 337 but is permitted rotation in block 333.

The end of shaft 335 carries a pin 338 that engages stops 339 in block 333 that limits the 180 degree positions of shaft 335.

A spring biased pin 341 in slot 342 and the top of block 333 has a inner end, not illustrated, that is received in one of two diametral recesses in shaft 335 to lock the shaft 335 in either of its 180 degree positions.

As seen in FIG. 40, the slide extrusion 322 is slidable on rods 325, 326, and 327, and has clamping assemblies, such as illustrated at 345, for locking the slide 322 in any desired position along the free length of rods 325, 326 and the 327.

As seen in FIGS. 34, 35, 36, 37, 38, and 39, the pivot assembly 316 includes a first pivot assembly 344 and a second pivot assembly 345. The first pivot assembly 344 includes block 337, which normally is locked to column head block 333 and a slide plate 346 that carries identical upper and lower pivot plates 348 and 349. Plates 348 and 349 have arcuate slots 351 therein that slidably receive pin assemblies 352, which are fixed to the upper and lower surfaces of the block 337. Plates 348 and 349 are journaled in block 337 by a pivot pin 354 that enables the pivot plates 348 and 349 and plate 346 to pivot about the axis of pin 354 during the golfer's follow through.

Figure 35:
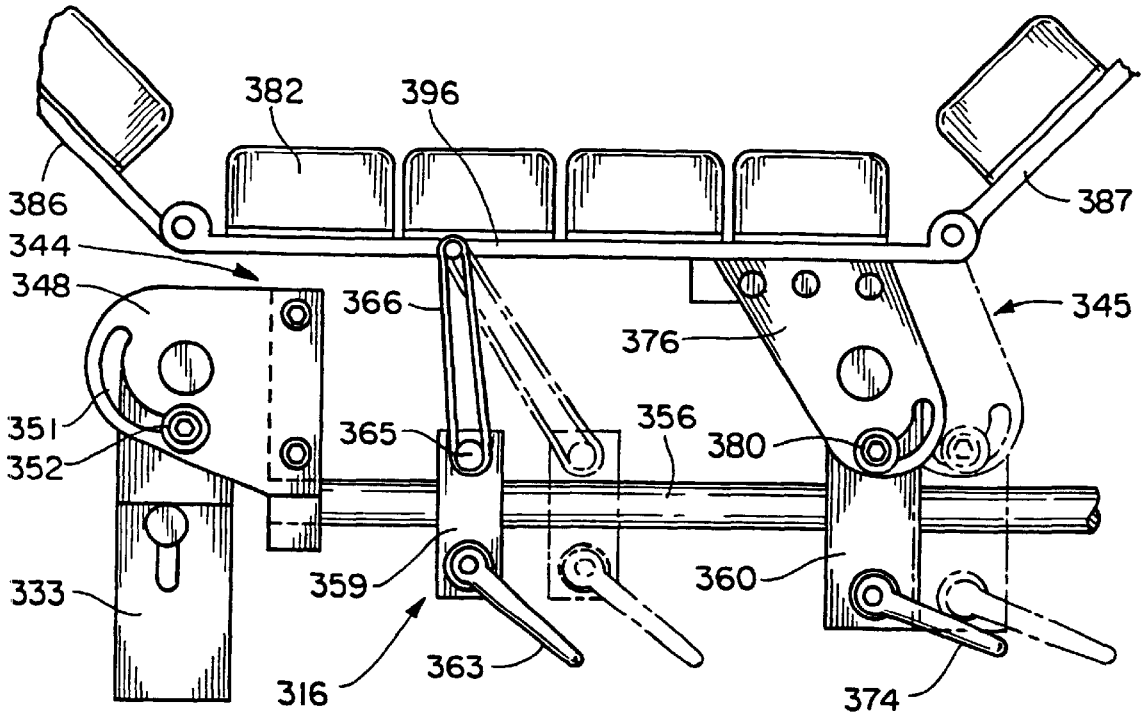
FIG. 35 is a top view of the pivot assembly and fragmented belt assembly illustrated in FIG. 34.

As seen in FIG. 35, slot 351 has a left end beginning on a vertical axis in the plane of FIG. 35, passing through the center of pin 354 and extends past 90 degrees through a horizontal axis extending through the axis of pin 354 an additional 16 degrees, so that the arcuate extent of slot 351 is 106 degrees. Thus, slot 351 and pin assembly 352 limit the follow through motion of the slide 316 to 106 degrees, the position of the belt assembly illustrated in FIG. 49.

The plate 342 carries rods 356 and 357 that form the ways for a tension slide 359 and a belt assembly lock slide 360.

Tension slide 359 is split at 362 and carries a threaded member 363 extending through the slot that defines a clamp on rod 356 so that tension slide 359 can be locked in any of the available positions on the rods 356 and 357. Tension slide 359 has a headed pin 365 on its upper and lower surfaces that carry an elastomeric band 366 that encircles a similar headed pin 367 on belt assembly frame plate 369.

By moving slide 359 along rods 356 and 357, the tension on the belt assembly 318 can be infinitely varied within the limit of the free length of the rods 356 and 357. Tension slide 359 continuously biases the belt assembly 318 toward the address position illustrated in FIG. 35, in both the backswing and the follow through of the golfer.

The belt assembly slide 360 is mounted for independent movement on the rods 356 and 357 and includes a pair of slots 371 and 372 across which a threaded member 373 extends operated by handle 374 that together serve to clamp the slide 360 in any position on the rods 356 and 357.

Slide 360 carries a pivot pin 375 similar to pin 354 that rotatedly supports upper and lower pivot plates 376 and 377 fixed to the rear plate 369 of the belt assembly 318. This defines the second pivotal axis 345 that is operative during the golfer's backswing and limits pivotal movement of the pelvic area to 45 degrees during the backswing.

Toward this end, the plates 376 and 377 have an arcuate slot 379 therein having an arcuate length as shown in FIG. 35, of 45 degrees.

As seen in the plane of FIG. 35, a vertical axis extending through the center of pin 375 defines the left end slot 379, and it extends upwardly to the left from there an angle of 45 degrees.

Pin assemblies 380 ride in slots 379 and are fixed to the upper and lower surfaces of the slide 360. At the address position illustrated in FIG. 35, which is also the ball impact position, pin assemblies 380 engage the left end of slot 379, as viewed in FIG. 35, and engage the right end of slot 379 in the limit backswing position illustrated in FIG. 45.

The ends of the rods 356 and 357 are held together by end plate 382, shown in FIG. 33, even though not shown in FIG. 34 for clarity.

The belt assembly 318 includes the back plate 369 and four cushions 382 releasably attached to the back plate 369. All of the cushions in the belt assembly 318 are identical and releasably attached to the belt assembly by hook and loop elements 383 illustrated in FIG. 44. Each of the cushions 382 includes a layer 384 of an elastomer having a Shore A durometer of approximately 75 and the remainder portion 385 of the cushion is constructed of an elastomer having a durometer of substantially less than Shore A 10. The elastomers 384 and 385 are encased in a suitable fabric material not illustrated in FIG. 44.

Viewing FIG. 34, the belt assembly 318 includes a plurality of left links 386 and a plurality of right links 387 pivoted to belt assembly back plate 369 by pins 388 and 389 respectively. By pivoting the left links and the right links at this location directly to a straight portion of belt assembly back plate, 369, this eliminates the necessity for having the back plate 369 laterally adjustable while still accommodating a variety of pelvic sizes.

Figure 43:
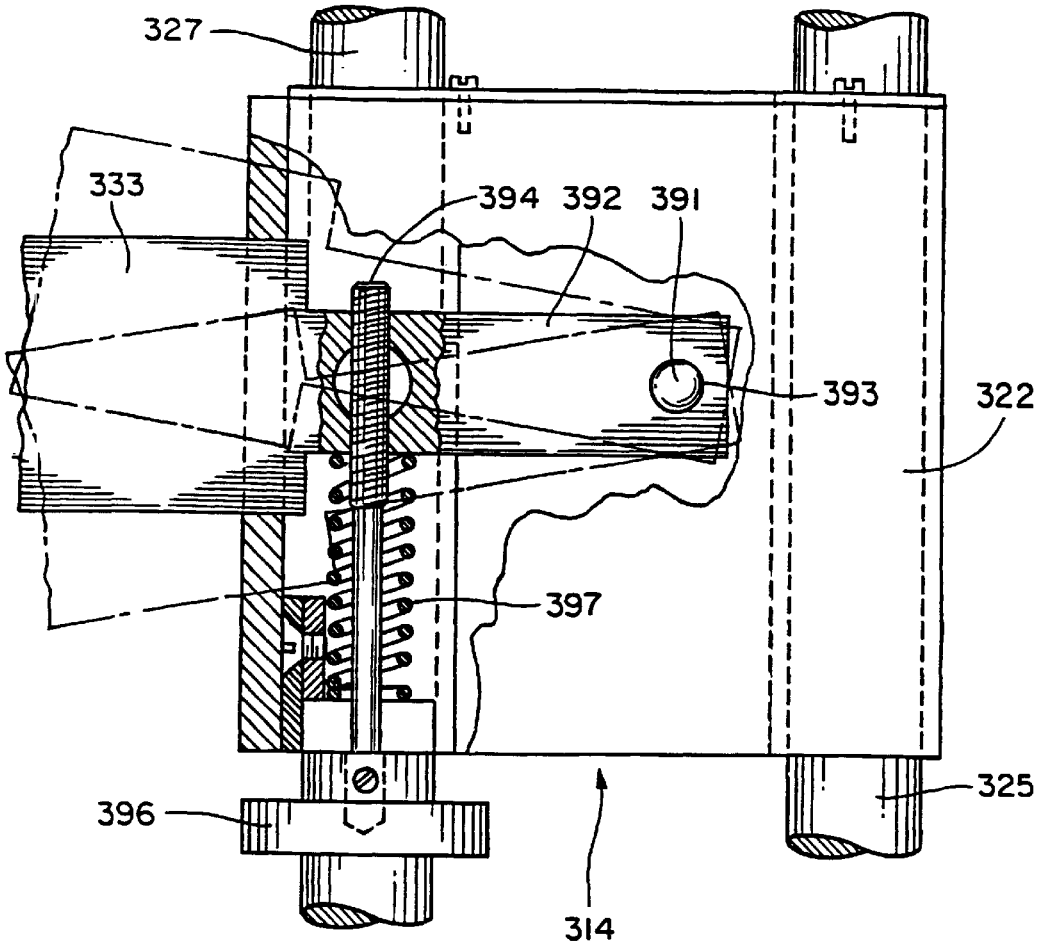
FIG. 43 is a fragmented side view of the column slide illustrating the belt tilt mechanism.
Figure 44:
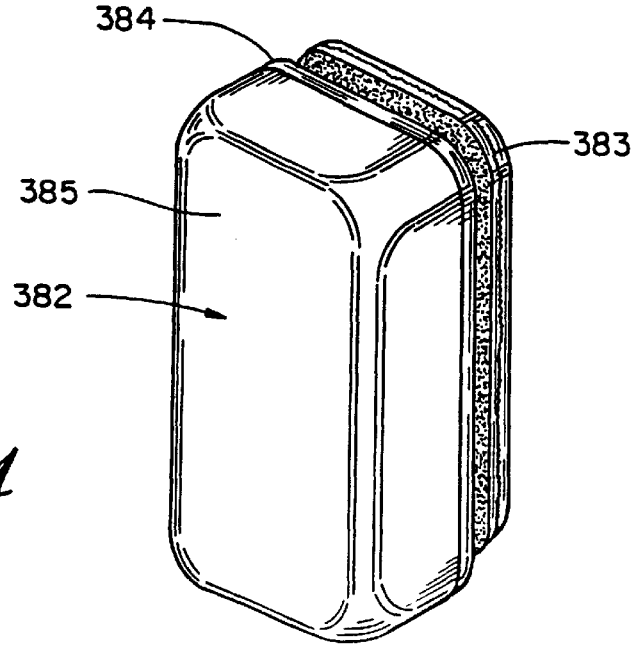
FIG. 44 is a perspective view of one of the belt assembly cushions.

As seen in FIG. 43, the column head block 333 is pivotally adjustable about a horizontal axis 391 to enable the belt assembly 318 to accommodate the golfer's proper pelvic tilt at the address position. Toward this end, the pivot block has a rearward extension 392 pivoted on horizontal shaft 393 fixed in the slide extrusion 322.

The angle position of the block 333 is adjusted by a threaded member 394 rotatedly mounted in the extrusion 322 and extending vertically through the block extension 393. Threaded member 394 is adjusted by a knurled operator 396 fixed thereto and a spring 397 eliminates play in this adjusting mechanism. While the block 333 is depicted in dotted lines above and below a horizontal position in FIG. 43, normally the angular position of the golf assembly would be downwardly from the horizontal in the appropriate address to accommodate the position of the golfer's hips.

Figure 29:
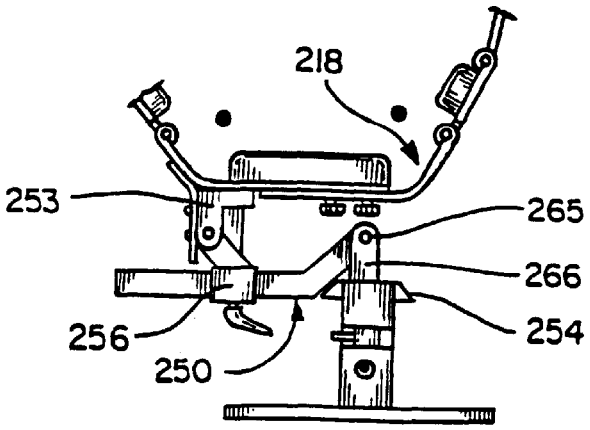
FIG. 29 is a fragmented top view showing the FIG. 20 embodiment belt assembly and pivot arm rotated to the left hand position.
Figure 31:
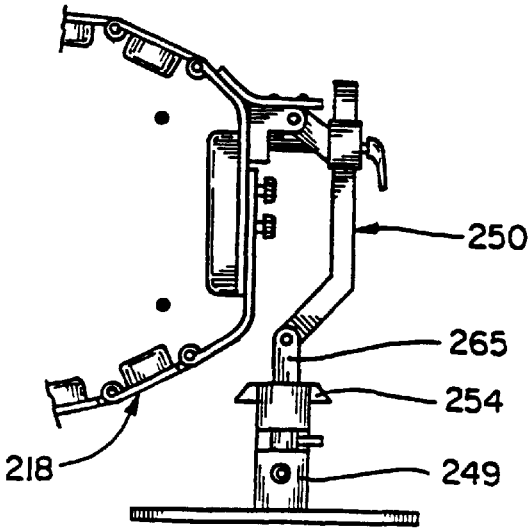
FIG. 31 is a fragmented top view similar to FIG. 30 in the follow through position.
Figure 32:
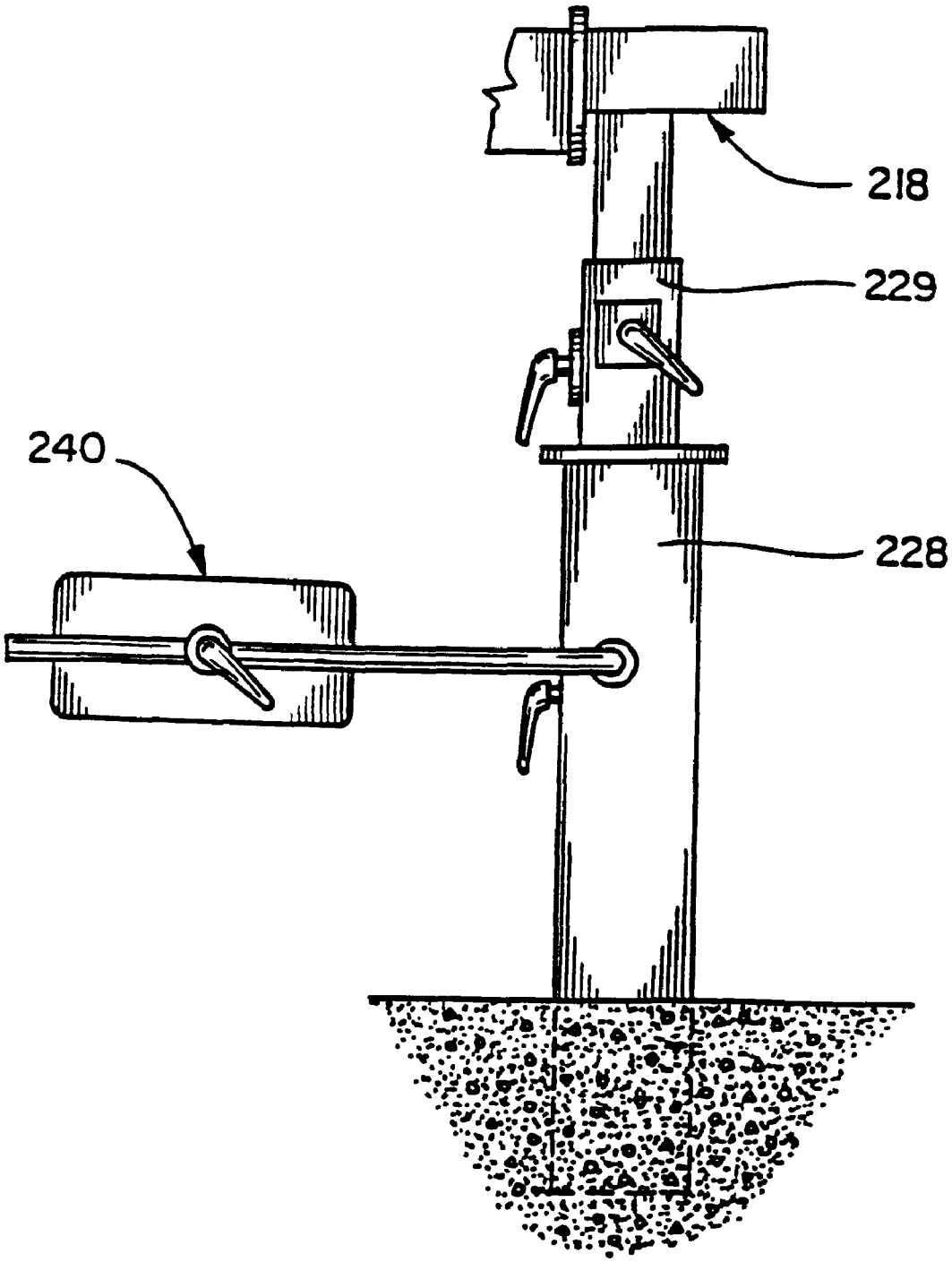
FIG. 32 is a fragmented left side view of an inground base embodiment.

The sequence of swing movements illustrated in FIGS. 45, 46, 47, 48 and 49, is generally similar to that depicted and described in FIGS. 29, 30 and 31 above, so that a detailed repetition is not believed necessary. In FIG. 45, the pivot assembly 345 limits the rotation of the belt assembly 318 from the address position to 45 degrees in a clockwise direction illustrated in the plane of FIG. 45.

As the golfer returns to the impact position illustrated in FIG. 46, the pivot assemblies 345 and 344 return to the FIG. 34 position.

Figure 47:
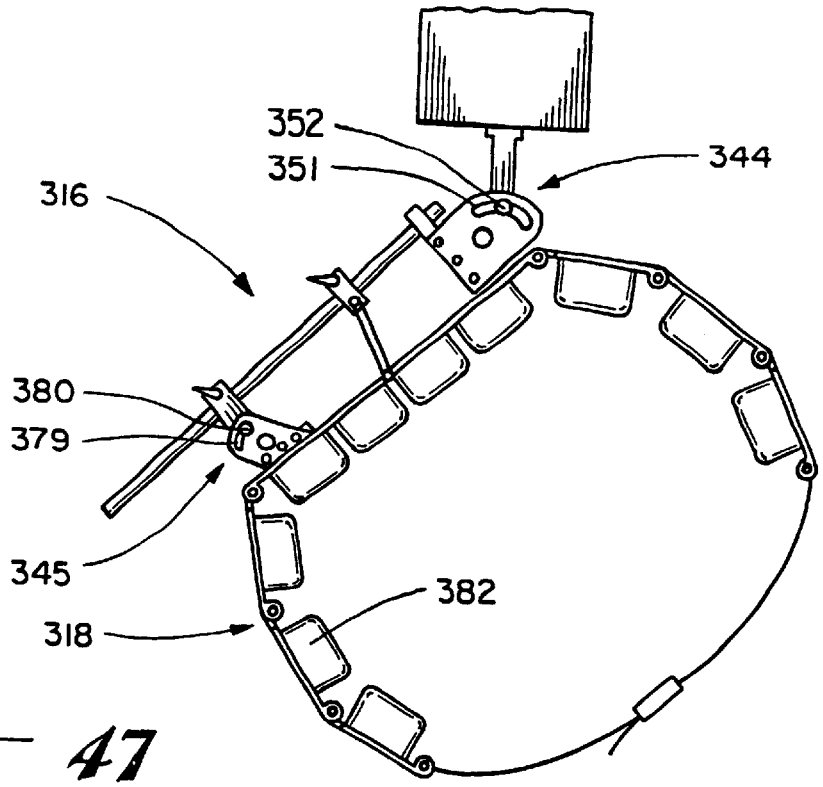

As the golfer begins the follow through illustrated in the 45 degree follow through position illustrated in FIG. 47, the pivot assembly 345 remains in the address position and the pivot assembly 344 permits the golfer to pivot about an axis behind the golfer's left hip socket as described above.

Figure 48:
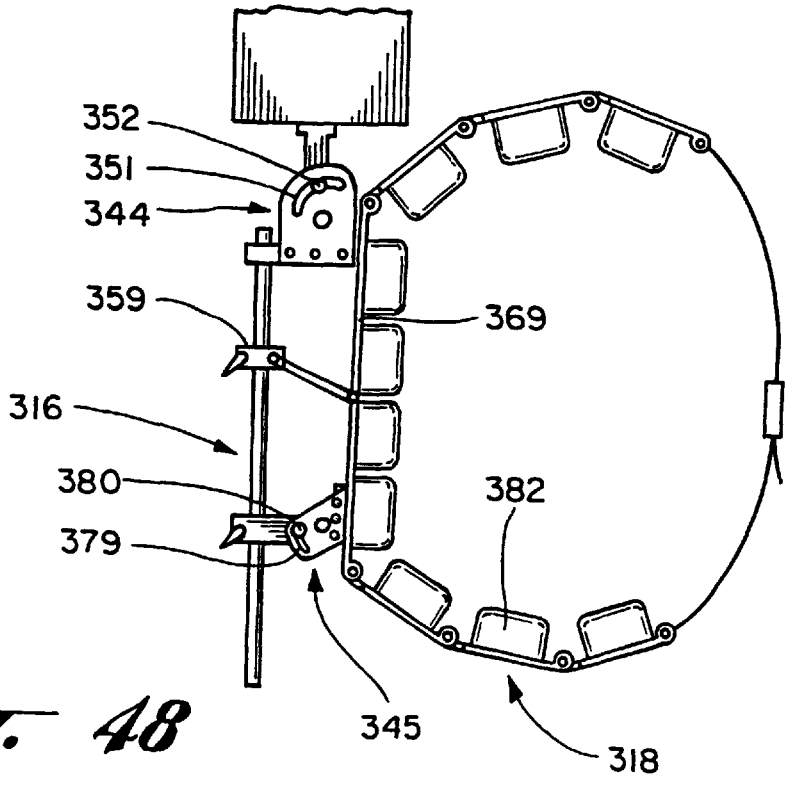
Figure 49:
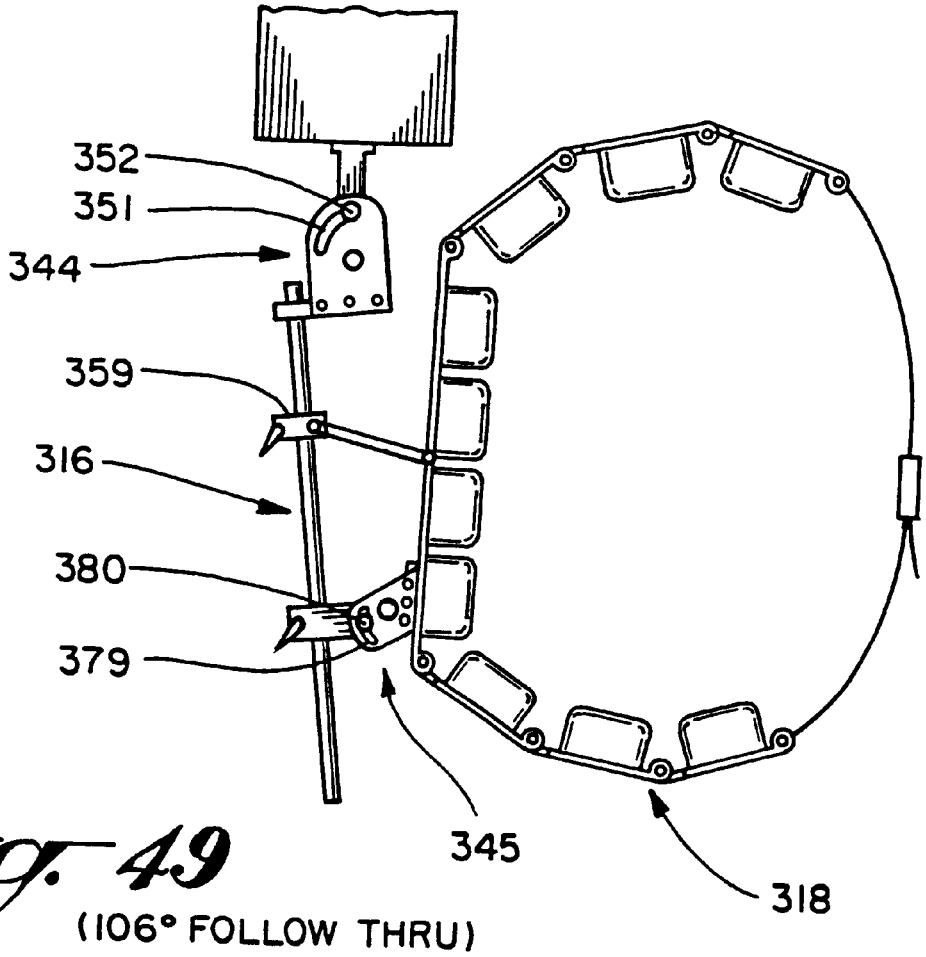

The pivot assembly 344 permits the golfer to rotate to a 90 degree follow through position illustrated in FIG. 48, and further to a 106 degree follow through position illustrated in FIG. 49 where pin assemblies 352 engage the upper right-hand portion of slot 351 as illustrated in FIG. 35.

What is claimed is:

1. A swing training system, comprising: a base, a hip belt assembly supported on the base adapted to encircle a substantial portion of the golfer's upper pelvic area, and means supporting the hip belt assembly on the base including a pivot arm interconnecting the belt assembly and the base, said pivot arm defining a way, a tension slide adjustably mounted on the pivot arm way independently of the belt assembly, and a tension element connected between the tension slide and the belt assembly for urging the belt assembly toward the tension slide.

2. A swing training system as defined in claim 1, wherein the tension element is an elastomeric belt.

3. A swing training system as defined in claim 1, wherein the tension element includes means for urging the belt assembly toward the tension slide in both the backswing and follow through of the golfer's swing.

4. A swing training system as defined in claim 1, wherein the pivot arm way includes at least two rods, said tension slide having apertures therein slidably received in the way rods.

5. A swing training system as defined in claim 4, wherein the belt assembly includes a slide adjustably positioned on the pivot arm way rods.

6. A swing training system as defined in claim 1, wherein the pivot arm is pivotally connected to the base about a first generally vertical axis and is pivotally connected to the belt assembly about a second generally vertical axis, said tension slide being adjustable on the pivot arm between and independently of the first and second axes.

7. A swing training system, comprising: a base, a hip belt assembly supported or the base adapted to encircle a substantial portion of the golfer's upper pelvic area, and means supporting the hip belt assembly on the base including a pivot arm interconnecting the belt assembly and the base, said pivot arm defining a way, a belt assembly slide adjustably positioned on the pivot arm way to accommodate different golfer anatomies, a tension slide mounted for movement on the pivot arm independently of the belt assembly slide, and a tension element interconnecting the tension slide and the belt assembly for urging the belt assembly toward the tension slide.

8. A swing training system as defined in claim 7, wherein the tension element is an elastomeric belt.

9. A swing training system as defined in claim 7, wherein the tension element includes means for urging the belt assembly toward the tension slide in both the backswing and follow through of the golfer's swing.

10. A swing training system as defined in claim 7, wherein the pivot arm way includes at least two rods, said tension slide having apertures therein slidably received on the way rods.

11. A swing training system as defined in claim 10, wherein the belt assembly slide includes a slide adjustably positioned on the pivot arm way rods.

12. A swing training system as defined in claim 7, wherein the pivot arm is pivotally connected to the base about a first generally vertical axis and is pivotally connected to the belt assembly about a second generally vertical axis, said tension slide being adjustable on the pivot arm between and independently of the first and second axis.

13. A swing training system as defined in claim 12, including means for limiting pivotal movement about the first and second axes including a plate with an arcuate slot therein and a pin slidable in the arcuate slot.

14. A swing training system, comprising: a base, a hip belt assembly supported on the base adapted to encircle a substantial portion of the golfer's upper pelvic area, and means supporting the hip belt assembly on the base including a pivot arm interconnecting the belt assembly and the base, means for limiting pivotal movement of the belt assembly relative to the pivot arm including a plate with an arcuate recess therein and a pin slidable in the plate recess.

15. A swing training system as defined in claim 14, wherein the recess has an arcuate length of about 45 degrees.

16. A swing training system as defined in claim 14, including means for limiting pivotal movement of the pivot arm relative to the base, including a plate with an arcuate recess therein and a pin slidable in the plate recess.

17. A swing training system, comprising: a base, a column projecting upwardly from the base, a hip belt assembly supported on the column adapted to encircle a substantial portion of the golfer's upper pelvic area, and means supporting the hip belt assembly on the column including a pivot arm interconnecting the belt assembly and the column, said column including a generally horizontal frame element supporting the pivot arm, said generally horizontal frame element being pivotally mounted in the column about a generally horizontal axis to accommodate the set-up position of the golfer's pelvic area without moving the column in a vertical plane.

18. A swing training system as defined in claim 17, including means to adjust the angular position of the frame element and the belt assembly about the generally horizontal axis.

19. A swing training system as defined in claim 18, wherein the means to adjust the angular position of the frame element and the belt assembly includes a threaded member threadedly engaged in the frame element and having a manual operator thereon.

20. A swing training system, comprising: a base, a hip belt assembly supported on the base adapted to encircle a substantial portion of the golfer's upper pelvic area, and means supporting the hip belt assembly on the base including a pivot arm interconnecting the belt assembly and the base, said base including at least three generally vertical posts extending substantially above the belt assembly and pivot arm, and a belt assembly frame vertically adjustable on the base posts to vary the vertical height of the belt assembly.

21. A swing training system as defined in claim 20, wherein there are three vertical posts.

22. A swing training system as defined in claim 21, wherein the belt assembly frame is generally triangular and has three through bores therein received on the three base posts.

23. A swing training system, comprising: a base, a hip belt assembly supported on the base adapted to encircle a substantial portion of the golfer's upper pelvic area, and means supporting the hip belt assembly on the base including a pivot arm interconnecting the belt assembly and the base, said belt assembly including a plurality of links adapted to conform to various pelvic configurations, and a plurality of body engaging cushions on the links, each including a high durometer portion adjacent the links and an integral low durometer portion extending therefrom.

24. A swing training system as defined in claim 23, wherein the cushions have an outermost fabric layer.

25. A swing training system as defined in claim 23, wherein the high durometer portion has a Shore A durometer of approximately 75 and the low durometer portion has a durometer less than Shore A 20.

26. A swing training system as defined in claim 23, wherein all of the cushions are identical to one another.

27. A swing training system as defined in claim 23, wherein each of the cushions is attached to the links by releasable hook and loop fasteners.

* * * * *